US008678748B2

(12) United States Patent
Kobayashi

(10) Patent No.: US 8,678,748 B2
(45) Date of Patent: Mar. 25, 2014

(54) BLOWER FAN UNIT AND BLOWER FAN SYSTEM

(75) Inventor: Shinichi Kobayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 500 days.

(21) Appl. No.: 13/005,327

(22) Filed: Jan. 12, 2011

(65) Prior Publication Data

US 2011/0182713 A1 Jul. 28, 2011

(30) Foreign Application Priority Data

Jan. 22, 2010 (JP) ..... 2010-012121

(51) Int. Cl.
*F01D 17/00* (2006.01)

(52) U.S. Cl.
USPC ..... 415/51; 415/118; 415/127; 415/206

(58) Field of Classification Search
USPC ..... 416/100; 310/62; 417/423.14
See application file for complete search history.

(56) References Cited

U.S. PATENT DOCUMENTS

| | | | | |
|---|---|---|---|---|
| 3,467,302 | A * | 9/1969 | Wilson | 416/20 R |
| 3,565,343 | A * | 2/1971 | Alderfer | 239/261 |
| 6,253,416 | B1 * | 7/2001 | Lauer et al. | 15/361 |
| 6,318,695 | B1 * | 11/2001 | Hu | 248/371 |
| 7,029,391 | B2 | 4/2006 | Nagaya et al. | |
| 7,347,669 | B1 * | 3/2008 | Patrick et al. | 416/31 |

FOREIGN PATENT DOCUMENTS

| | | | |
|---|---|---|---|
| JP | 2001-295796 | A | 10/2001 |
| JP | 2001-355593 | A | 12/2001 |
| JP | 2005-104186 | A | 4/2005 |

* cited by examiner

*Primary Examiner* — Edward Look
*Assistant Examiner* — Danielle M Christensen
(74) *Attorney, Agent, or Firm* — Fujitsu Patent Center

(57) ABSTRACT

A blower fan unit includes a housing, a fan, a support unit to support the housing rotatably, and a exhaust tube projecting from the outlet, the exhaust tube producing a reaction force by guiding the airflow toward an upstream side of movement of the peripheral surface synchronized with rotation of the housing, the reaction force rotating the housing toward a downstream side of the movement of the peripheral surface of the housing, a stopper being positioned on a movement path of the exhaust tube that moves with the rotation of the housing to stop the rotation of the housing by blocking movement of the exhaust tube, and a switch mechanism to switch blocking and restarting of the movement of the exhaust tube using the stopper.

17 Claims, 13 Drawing Sheets

FIG.6A

334

| IDENTIFICATION NUMBER OF TEMPERATURE SENSOR | ANGLE DIRECTION |
|---|---|
| 1 | θ1 |
| 2 | θ2 |
| ⋮ | ⋮ |
| n | θn |

FIG.6B

335

| TEMPERATURE RANGE | STOP TIME |
|---|---|
| d<D1 | t1 |
| D1 ≦ d<D2 | t2 |
| ⋮ | ⋮ |
| Dn≦d | tn |

FIG.6C

336

| ANGLE DIRECTION | STOP TIME |
|---|---|
| θa | ta |
| θb | tb |
| ⋮ | ⋮ |

BLOWER FAN UNIT AND BLOWER FAN SYSTEM

CROSS-REFERENCE TO RELATED APPLICATIONS

This application is based upon and claims the benefit of priority of the prior Japanese Patent Application No. 2010-12121, filed on Jan. 22, 2010, the entire contents of which are incorporated herein by reference.

FIELD

The embodiments discussed herein are related to a technology for a blower fan unit and blower fan system.

BACKGROUND

For instance, a blow fan unit is a well-known unit that generates the air that prevents the ambient temperature of each computer from rising to an excessive value in the room that a plurality of computers are located. As one example of the blower fan units, there is a blow fan unit for blowing the air while rotating so as to blow the air for cooling in various directions. For instance, refer to Japanese Laid-opened Patent Publication No. 2001-295796, Japanese Laid-opened Patent Publication No. 2001-355593 and Japanese Laid-opened Patent Publication No. 2005-104186. As this blower fan unit blows the air to a plurality of locations in the room, the room is evenly cooled.

Here, each computer located in a room has a different state of operation from one another. Therefore, each computer has a different level of heat generation, namely a different level of temperature rise occurs at a plurality of locations in the room. When such a room is cooled, it is difficult to evenly cool the room by simply rotating the blower fan unit. On the other hand, even if the room is evenly cooled, there is a demand to avoid, for instance, a complicated rotation mechanism because of the cost of the blower fan unit.

SUMMARY

According to an aspect of the invention, a blower fan unit includes a housing having an outlet opened on a peripheral surface of the housing and an inlet opened on a surface other than the peripheral surface of the housing, a fan to generate an airflow from the inlet to the outlet, the fan being arranged in the housing, a support unit to support the housing rotatably, an exhaust tube projecting from the outlet, the exhaust tube producing a reaction force by guiding the airflow toward an upstream side of movement of the peripheral surface synchronized with the rotation of the housing, the reaction force rotating the housing toward a downstream side of the movement of the peripheral surface of the housing, a stopper being positioned on a movement path of the exhaust tube that moves with the rotation of the housing to stop the rotation of the housing by blocking movement of the exhaust tube, and a switch mechanism to switch blocking and restarting of the movement of the exhaust tube using the stopper.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

FIGS. 6A to 6C illustrate in detail an angle table, a time table and an instruction table illustrated in FIG. 5, respectively.

DESCRIPTION OF EMBODIMENTS

Hereafter, before describing a blow fan unit and a blow fan system of embodiments, a blow fan unit of a comparative example to compare with a blow fan unit of the embodiment is described below.

Figure 1:
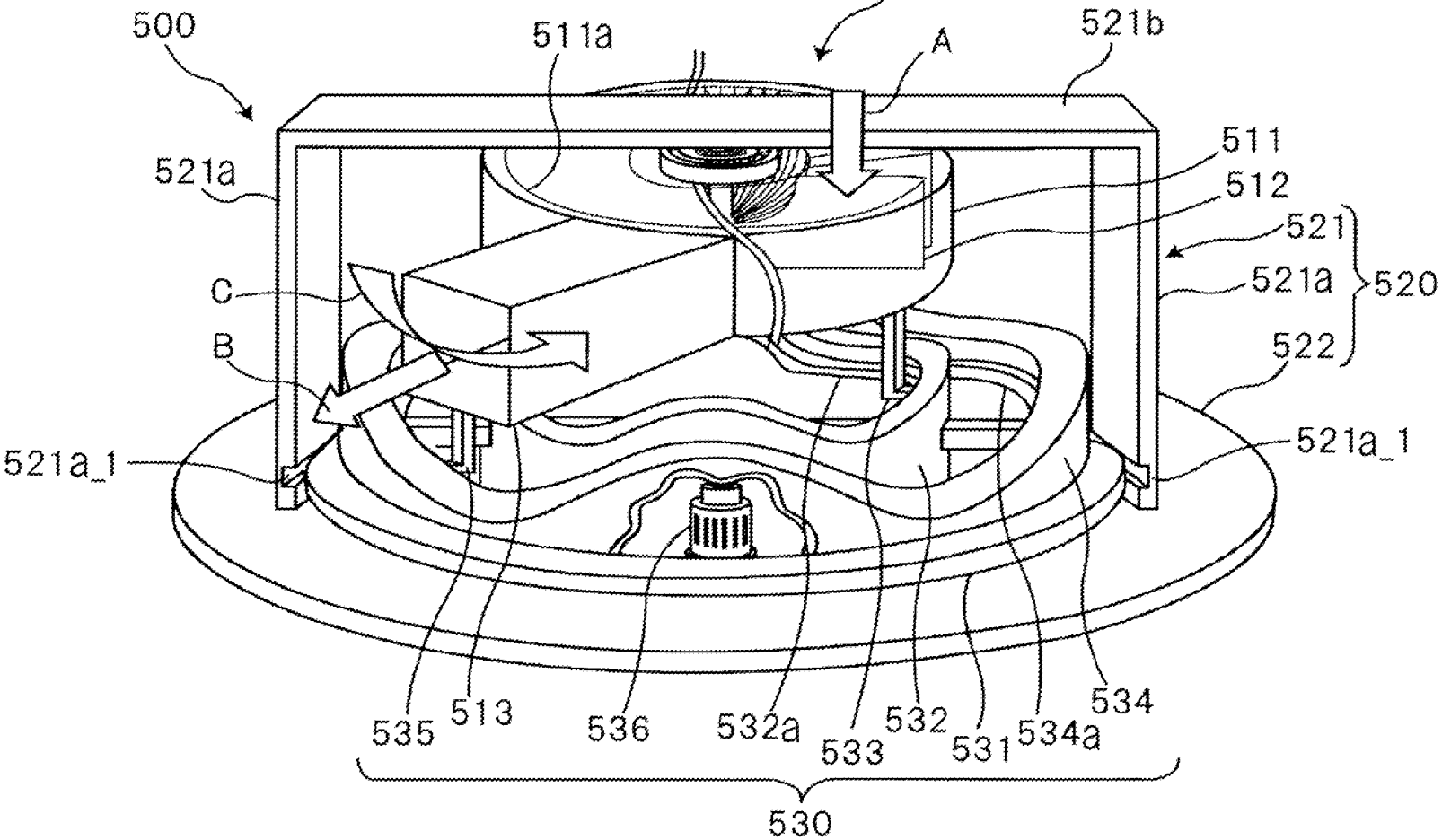
FIG. 1 schematically illustrates a perspective view of a blow fan unit as a comparative example.
Figure 2:
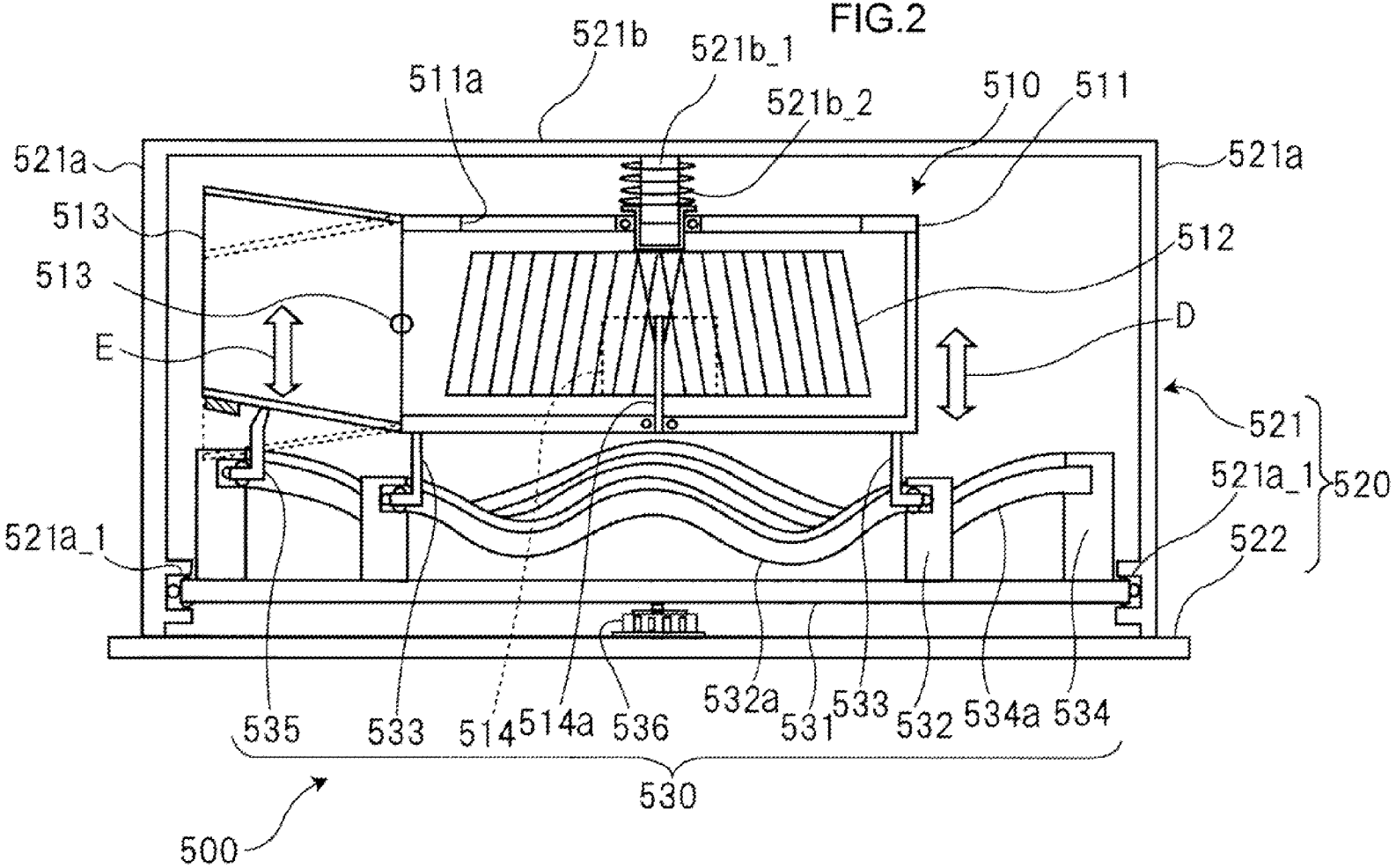
FIG. 2 schematically illustrates an inner structure of the blow fan unit as the comparative example.

FIG. 1 schematically illustrates a perspective view of a blow fan unit 500 as a comparative example. Moreover, FIG. 2 schematically illustrates an internal structure of the blow fan unit 500.

Hereafter, a blow fan system of the comparative example is described with reference to both FIG. 1 and FIG. 2.

A blower fan unit 500 as the comparative example includes a main body 510, a housing 511 that is a component of the main body 510, a support unit 520 that rotatably supports the housing 511 and a displacement mechanism 530 that changes the position of the housing 511 and the position of an exhaust tube 513 described later.

In FIG. 1, the main body 510 is illustrated by a perspective view of a part of the internal structure of the main body 510.

The main body 510 includes the housing 511, a fan 512, the exhaust tube 513 and a fan rotation motor 514.

The housing 511 has a hollow circular cylindrical shape. The fan 512 is rotated about a rotation shaft 514*a* by the fan rotation motor 514 built into the housing 511. The axis of the rotation shaft 514*a* coincides with a center axis of the housing 511 of the circular cylindrical shape. An inlet 511*a* is opened on the upper surface, which is opposed to a support plate 521*b* described later, of the upper and lower surfaces other than the peripheral surface of the housing 511. Moreover, the outlet is opened on the peripheral surface of the housing 511.

When the fan 512 rotates in the housing 511, an air is taken into the housing 511 from the inlet 511*a* by the rotation as denoted by an arrow A in FIG. 1. The air flows along inner surface of the housing 511 by the rotation of the fan 512. As a result, the airflow is generated from the inlet 511*a* toward the outlet that is opened on the peripheral surface of the housing 511.

The exhaust tube 513 has a square cylinder shape. This exhaust tube 513 projects from the outlet that is opened on the peripheral surface of the housing 511. Moreover, a direction of projection is nearly a direction tangential to the outlet that is opened on the peripheral surface of the housing 511. The air generated by the fan 512 is exhausted outside the housing 511 from the exhaust tube 513 as denoted by arrow B in FIG. 1. As the direction of projection is nearly the direction tangential to the outlet that is opened on the peripheral surface of the housing 511, reaction force generated by the air exhausted from the outlet is applied to the housing 511 when the air is exhausted. Therefore the housing 511 is pushed in the direction along the peripheral surface by the reaction force. Moreover, the exhaust tube 513 is swingably provided about a swinging shaft 513*a* as illustrated in FIG. 2. The swinging shaft 513*a* is extended in the direction that intersects with an exhaust direction denoted by arrow B in FIG. 1.

The support unit 520 includes a fixed base 522 and a frame 521.

The fixed base 522 is formed into a disc shape. The frame 521 includes two columns 521*a* and the support plate 521*b*.

The two columns 521*a* stand at the edge of the fixed base 522 and are provided at diametrically opposite positions with respect to the center of the fixed base 522. A support groove 521*a*_1 is formed in each of the two columns 521*a* to rotatably support a rotation base 531 described later.

The support plate 521*b* extends passing over the center of the fixed base 522 and couples the two columns 521*a* each other. A support shaft 521*b*_1 that rotatably supports the housing 511 is fixed on the support plate 521*b* at the position opposed to the center of the fixed base 522. The support shaft 521*b*_1 projects toward the fixed base 522. The upper center part of the housing 511 is rotatably provided with the support shaft 521*b*_1 through a bearing. When the air is exhausted from the outlet, the housing 511 is pushed in the direction along the peripheral surface of the housing 511 by the reaction force of the airflow as described above. As the housing 511 is rotatably provided with the support shaft 521*b*_1, the housing 511 rotates about the support shaft 521*b*_1 by the reaction force in the direction along the peripheral surface (in the direction denoted by arrow C in FIG. 1) when the air is exhausted. Namely, the exhaust tube 513 produces a reaction force by guiding the airflow toward an upstream side of the movement of the peripheral surface synchronized with the rotation of the housing 511, and the reaction force rotates the housing 511 toward a downstream side of the movement of the peripheral surface of the housing 511.

In addition, the housing 511 is provided with the support shaft 521*b*_1 so that the housing 511 is movable in a vertical direction along the support shaft 521*b*_1 as illustrated in FIG. 2. A coil spring 521*b*_2 is provided between the upper surface of the housing 511 and the support plate 521*b*. The coil spring 521*b*_2 is penetrated by the support shaft 521*b*_1. Further the coil spring 521*b*_2 is provided so as to sandwich in an arm described later between the coil spring 521*b*_2 and the support plate 521*b*. The housing 511 is biased toward the fixed base 522 by the coil spring 521*b*_2.

The housing 511 rotates by the reaction force generated by the exhaust air in the direction denoted by arrow C in FIG. 1. As a result, the air is exhausted in an each angle direction on the circumference which centers on the rotation shaft 514*a* of the fan 512 or the support shaft 521*b*_1. Here, the exhaust air rotates the housing 511 at a constant rotation speed.

The displacement mechanism 530 includes a rotation base 531, an inner peripheral wall 532, a housing guide section 533, an outer peripheral wall 534, an exhaust tube guide section 535, and a base rotation motor 536.

Moreover, FIG. 1 illustrates a perspective view of the blow fan unit 500, with a part of the rotation base 531 and inner peripheral wall 532 and outer peripheral wall 534 broken away to illustrate the base rotation motor 536 which is provided under the central part of the rotation base 531.

The rotation base 531 has a disc shape that is smaller than the fixed base 522. The rotation base 531 is provided so that the center of fixed base 522 is opposed to the center of rotation base 531. The edge of this rotation base 531 is engaged with a support groove 521*a*_1 of each of the two columns 521*a* through a bearing. Therefore, the rotation base 531 is rotatably supported about the center axis of the rotation base 531 by the two columns 521*a*.

The inner peripheral wall 532 is a circular cylindrical wall standing from the rotation base 531 toward the housing 511. The center axis of the inner peripheral wall 532 coincides with the center axis of the rotation base 531. A housing guide groove 532*a* that guides the housing guide section 533 described later is provided on the inner peripheral surface of the inner peripheral wall 532. The housing guide groove 532*a* is formed in the shape of the sine wave having a constant period to meander on the inner peripheral surface of the inner peripheral wall 532. And, the top edge of the inner peripheral wall 532, which is near the housing 511, is formed into a meandering shape corresponding to the meandering shape of the housing guide groove 532*a*.

The housing guide section 533 has the shape that projects from the bottom of the housing 511 opposed to the rotation base 531 toward inside of the inner peripheral wall 532. And the housing guide section 533 has the shape that the front end of the housing guide section 533 bends toward the inner peripheral surface of the inner peripheral wall 532. The bottom of the housing 511 is formed in a circle shape. The two housing guide sections 533 project from the edge of the bottom of the housing 511 and are provided at diametrically opposite positions with respect to the center of the bottom of the housing 511. And the front end of the housing guide section 533 engages the housing guide groove 532*a* through a bearing. The front end of the housing guide section 533 moves in the housing guide groove 532*a* on the basis of this structure.

The outer peripheral wall 534 is a wall of a circular cylindrical shape that encloses the inner peripheral wall 532. The outer peripheral wall 534 is provided to stand on the rotation base 531 toward the housing 511. The center axis of this outer peripheral wall 534 coincides with the center axis of the rotation base 531. A housing guide groove 534*a* that guides an exhaust tube guide section 535 described later is provided on the inner peripheral surface of the outer peripheral wall 534. The housing guide groove 534*a* is formed in the shape of the sine wave having the same period as the housing guide groove 532*a* to meander on the inner peripheral surface of the outer peripheral wall 534. And the top edge of the outer peripheral wall 534, which is near the housing 111, is formed into a meandering shape corresponding to the meandering shape of the housing guide groove 534*a*.

The exhaust tube guide section 535 has the shape that projects from the bottom of the exhaust tube 513 opposed to the rotation base 531 toward inside of the outer peripheral wall 534. The exhaust tube guide section 535 has the shape that the front end of the exhaust tube guide section 535 bends toward the inner peripheral surface of the outer peripheral wall 534. The front end of the exhaust tube guide section 535 engages the housing guide groove 534*a* through the bearing. The front end of the exhaust tube guide section 535 moves in the housing guide groove 534*a* on the basis of this structure.

The base rotation motor 536 rotates the rotation base 531 that is rotatably supported by the two columns 521*a*. The rotation speed of the rotation base 531 which rotates by the base rotation motor 536 is different from the rotation speed of the housing 511 which rotates by the exhaust air.

Moreover, it is not specified whether or not the rotation direction of the rotation base 531 is the same rotation direction as the housing 511. However, the base rotation motor 536 rotates the rotation base 531 so that the rotation base 531 rotates relative to the housing 511.

The inner peripheral wall 532 and the outer peripheral 534 with the rotation base 531 rotate relative to the housing 511 by the rotation of the base rotation motor 536. As a result, the front end of the housing guide section 533 moves in the housing guide groove 532*a* of the inner peripheral wall 532, and the front end of the exhaust tube guide section 535 moves in the housing guide groove 534*a* of the outer peripheral wall 534.

The housing 511 repeats to move up and down in the direction denoted by arrow D in FIG. 2 along the support shaft 521*b*_1 while the front end of the housing guide section 533 moves along the meandering path of the housing guide groove 532*a*. In addition, the exhaust tube 513 repeats to move up and down in the direction denoted by arrow E in FIG. 2 along the rotation shaft 514*a* while the front end of the exhaust tube guide section 535 moves along the meandering path of the housing guide groove 534*a*.

Here, as illustrated in FIG. 2, the exhaust tube guide section 535 is provided at the position that shifts from the extension line of line up of the housing guide sections 533. Therefore, the front end of the exhaust tube 513 moves up and down in a phase different from a phase that the housing 511 moves up and down. As a result, the front end of the exhaust tube 513 moves up and down relative to the housing 511, and the air is exhausted from the exhaust tube 513 while changing the direction of the exhaust tube 513 upward or downward in each angle direction on the circumference that centers on the axis of the support shaft 521*b*_1. The axis of the support shaft 521*b*_1 intersects with the axis of the exhaust tube 513 when the exhaust tube 513 swings in upward direction or in downward direction.

Here, the blow fan unit is provided, for instance, as aim to provide the blow fan unit that generates the air that prevents temperature at many locations in the room from rising to an excessive value in the room that a plurality of computers are provided. As described above, according to the blow fan unit 500 of the comparative example, the blow fan unit 500 blows the air at many locations in the room by the rotation of the housing 511. However, since each computer provided in the room operates in a different state, a variation may take place at the level of heat generation in each computer, namely, at the level of the temperature rise at many locations in the room. In the blower fan unit 500 of the comparative example, the air evenly blows at many locations in the room. On the other hand, in the blower fan unit 500 of the comparative example, although the temperature rise is different at many locations, the air for cooling the room similarly blows at many locations in the room. Therefore, since the air similarly blows at a location of large temperature rise or small temperature rise, it is difficult to cool the room in a good balance. Here, the rotation mechanism of the blow fan unit 500 is probably improved, for instance, for a well-balanced cooling. However, it is desirable to avoid the complication of a rotation mechanism in terms of cost.

Relative to the blow fan unit 500 of the comparative example, a blower fan unit in embodiments described below has a simple mechanism and has a method to cool the room in a good balance.

Hereafter, embodiments of a blow fan unit and a blower fan system are described in detail, though there are some parts that overlap with the description of the blow fan unit 500 of the comparative example.

First of all, a first embodiment is described below.

Figure 3:
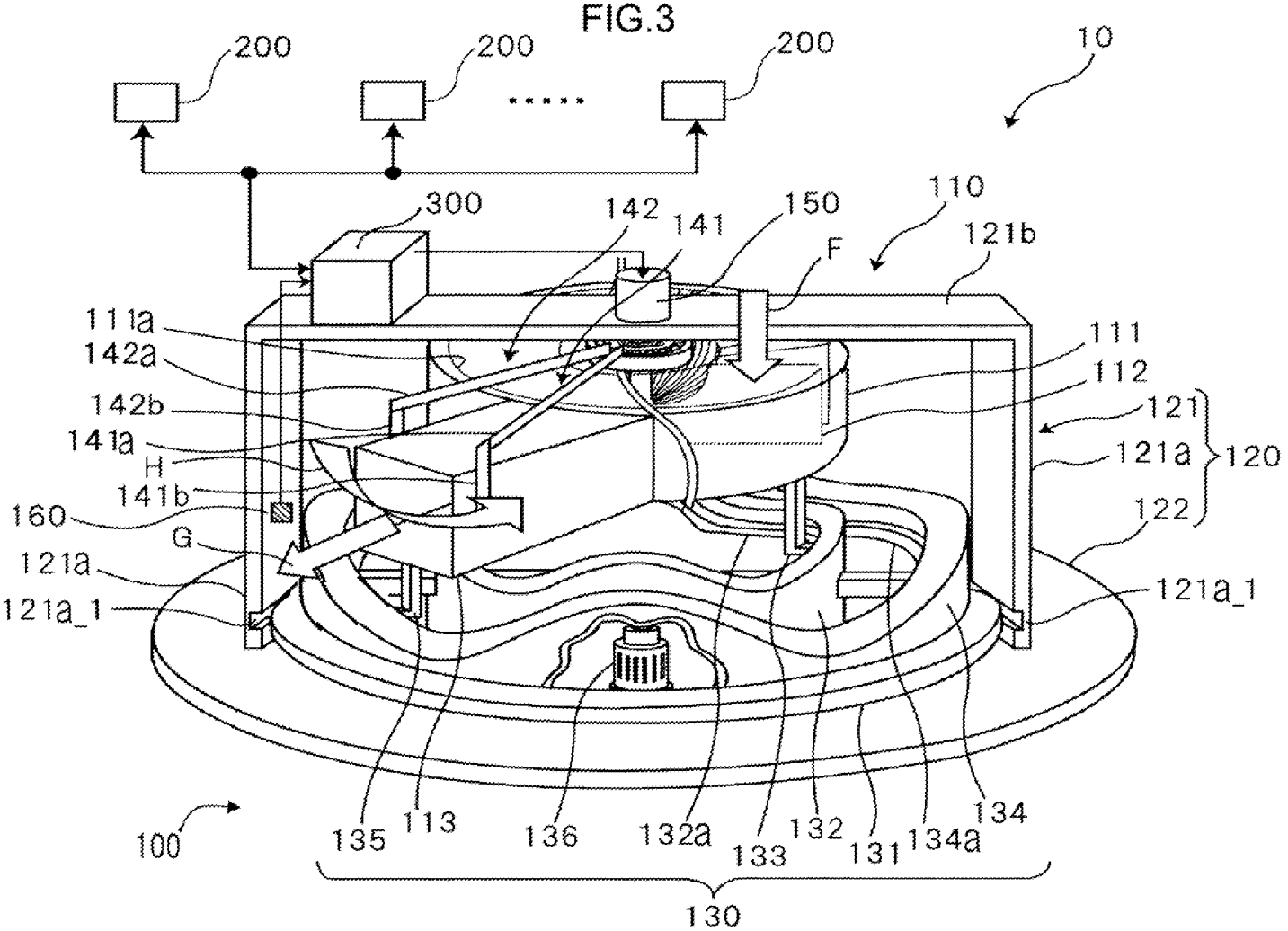
FIG. 3 schematically illustrates a perspective view of a blow fan system according to a first embodiment.

FIG. 3 schematically illustrates a perspective view of a blow fan system 10 according to the first embodiment. Moreover, FIG. 4 schematically illustrates the blow fan unit according to the blow fan system in FIG. 3 focusing on an internal structure of the blow fan unit.

Figure 4:
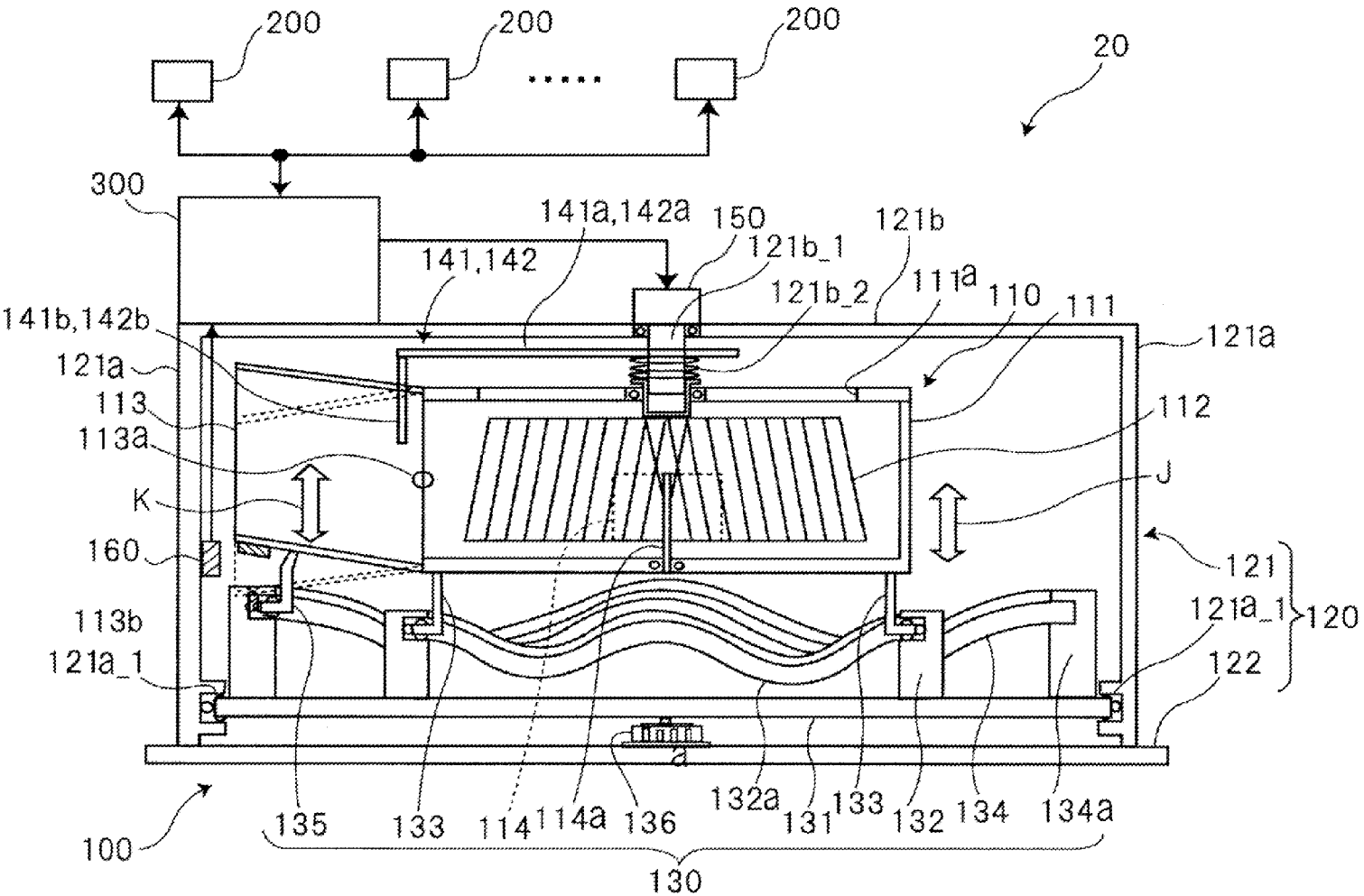
FIG. 4 schematically illustrates according to the blow fan system in FIG. 3 focusing on an inner structure of the blow fan unit.

Hereafter, the blow fan system 10 of the first embodiment is described referring to both FIG. 3 and FIG. 4.

The blow fan system 10 of the first embodiment includes a blower fan unit 100, a plurality of temperature sensors 200 and a control device 300.

Here, FIG. 3 and FIG. 4 illustrate the blow fan unit 100 according to the first embodiment.

The blow fan unit 100 of the first embodiment includes a main body 110, a support unit 120 and a displacement mechanism 130. The main body 110 includes a housing 111. The support unit 120 rotatably supports the housing 111. The displacement mechanism 130 changes the position of the housing 111 and the position of an exhaust tube 113 described later.

FIG. 3 is a perspective view of a part of an internal structure of the main body 110.

The main body 110 includes the housing 111, a fan 112, the exhaust tube 113, and a fan rotation motor 114.

The housing 111 has a hollow circular cylindrical shape. The fan 112 is rotated about a rotation shaft 114*a* by the fan rotation motor 114 built into the housing 111. The axis of the rotation shaft 114*a* coincides with a center axis of the housing 111 having the circular cylindrical shape. An inlet 111*a* is opened on the upper surface, which is opposed to a support plate 121*b* described later, of upper and lower surfaces other than the peripheral surface of the housing 111. Moreover, the outlet is opened on the peripheral surface of the housing 111. The housing 111 is one example of a housing that has an inlet, which is opened on a part other than the peripheral surface, and an outlet which is opened on the peripheral surface. Moreover, the peripheral surface of the housing 111 having the circular cylinder shape is one example of a round peripheral surface. The round peripheral surface may be, for instance, a peripheral surface having a shape other than a circular cylinder shape such as an elliptic cylinder shape.

When the fan 112 rotates in the housing 111, the air is taken into the housing 111 as denoted by arrow F in FIG. 3 from the inlet 111*a* by the rotation. The fan 112 is so-called a centrifugal fan, and the air taken into the housing 111 flows along the inner surface of the housing 111 by the centrifugal force generated by the rotation of the fan 112. As a result, the air flows from the inlet 111*a* to the outlet that is opened on the peripheral surface. The fan 112 is one example of a fan that generates the airflow. Here, a fan that generates the airflow may not limit to a centrifugal fan, and may be, for instance, an axial flow fan.

In the first embodiment, a normal fan speed and a high fan speed which is higher than the normal fan speed are preliminarily determined as a rotational speed of the fan rotation motor 114, namely, a rotational speed of the fan 112. When a control device 300 described later drives the fan rotation motor 114 at the normal fan speed, the fan 112 is rotated at the normal fan speed by the fan rotation motor 114. Moreover, when the control device 300 drives the fan rotation motor 114 at the high fan speed, the fan 112 is rotated at the high fan speed by the fan rotation motor 114.

The exhaust tube 113 has a square cylinder shape. This exhaust tube 113 projects from the outlet that is opened on the peripheral surface of the housing 111. Moreover, a direction of projection is nearly a direction tangential to the outlet that is opened on the peripheral surface of the housing 111. The air generated by the fan 112 is exhausted outside the housing 111 from the exhaust tube 113 as denoted by arrow G in FIG. 3. As the direction of projection is nearly the direction tangential to the outlet that is opened on the peripheral surface of the housing 111, reaction force generated by the air exhausted from the outlet is applied to the housing 111 when the air is exhausted. Therefore the housing 111 is pushed in the direction along the peripheral surface by the reaction force. Moreover, the exhaust tube 113 is swingably provided about a swinging shaft 113*a* as illustrated in FIG. 4. The swinging shaft 113*a* is extended in the direction that intersects with an exhaust direction denoted by arrow G in FIG. 3.

The support unit 120 includes a fixed base 122 and a frame 121.

The fixed base 122 is formed into a disc shape. The frame 121 includes two columns 121*a* and a support plate 121*b*.

The two columns 121*a* stand at the edge of the fixed base 122 and are provided at diametrically opposite positions with respect to the center of the fixed base 122. A support groove 121*a*_1 is formed in each of the two columns 121*a* to rotatably support a rotation base 131 described later.

The support plate 121*b* extends passing over the center of the fixed base 122 and couples the two columns 121*a* each other. A support shaft 121*b*_1 that rotatably supports the housing 111 is provided at the position of the support plate 121*b* which is opposed to the center of the fixed base 122. The support shaft 121*b*_1 projects toward the fixed base 122 and is rotatably provided with the support plate 121*b* through a bearing. The upper center part of the housing 111 is rotatably provided with the support shaft 121*b*_1 through a bearing. When the air is exhausted from the outlet, the housing 111 is pushed in the direction along the peripheral surface of the housing 111 by the reaction force of the airflow as described above. As the housing 111 is rotatably provided with the support shaft 121*b*_1, the housing 111 rotates about the support shaft 121*b*_1 by the reaction force generated by the exhaust air in the direction along the peripheral surface in the direction denoted by arrow H in FIG. 3.

Namely, the exhaust tube 113 corresponds to one example of an exhaust tube that guides the airflow to the upstream side of the movement of the peripheral surface synchronized with the rotation of the housing 111. Thereby, the reaction force of the airflow rotates the housing 111 toward the downstream side of the movement of the peripheral surface. In the first embodiment, as one example of a projection structure of the exhaust tube, the structure that projects linearly in a near tangential direction to the peripheral surface is described. However, the projection structure of the exhaust tube is not limited to the above-described exhaust tube. For example, an exhaust tube may have a structure that projects in the normal direction to the peripheral surface and then bends in the direction apart from the normal direction.

In addition, the housing 111 is provided with the support shaft 121*b*_1 so that the housing 111 is movable in a vertical direction along the support shaft 121*b*_1 as illustrated in FIG. 4. A coil spring 121*b*_2 is provided between the upper surface of the housing 111 and the support plate 121*b*. The coil spring 121*b*_2 is penetrated by the support shaft 121*b*_1. Further the coil spring 121*b*_2 is provided so as to sandwich in an arm described later between the support plate 121*b* and the coil spring 121*b*_2. The housing 111 is forced toward the fixed base 122 by the coil spring 121*b*_2.

The housing 111 rotates by the reaction force generated by the exhaust air in the direction denoted by arrow H in FIG. 3. As a result, the air is exhausted from the main body 110 in each angle direction on a circumference that centers on the rotation shaft 114*a* or the support shaft 121*b*_1. Here, the housing 111 rotates at a constant rotational speed by the exhaust air if a stopper 141 or a pushing arm 142 does not operate.

As described above, the support unit 120 that rotatably supports the housing 111 corresponds to one example of a support member that rotatably supports the housing 111. The support structure of the housing 111 is not limited to the support shaft 121*b*_1. For example, a support structure of the housing 111 may be a structure that two columns support the peripheral surface of the housing 111 through a bearing.

The displacement mechanism 130 includes a rotation base 131, an inner peripheral wall 132, a housing guide section 133, an outer peripheral wall 134, an exhaust tube guide section 135, and a base rotation motor 136.

Moreover, FIG. 3 illustrates a perspective view of the blow fan unit 100, with a part of the rotation base 131 and a part of the inner peripheral wall 132 and a part of the outer peripheral wall 134 are broken away to illustrate the base rotation motor 136 which is provided under the central part of the rotation base 131.

The rotation base 131 has a disc shape that is smaller than the fixed base 122. The rotation base 131 is provided so that the center of fixed base 122 is opposed to the center of rotation base 131. And, the edge of this rotation base 131 is engaged with the support groove 121*a*_1 of each of the two columns 121*a* through a bearing. Therefore, the rotation base 131 is supported rotatably around the center axis of the rotation base 131 by the two columns 121*a*.

The inner peripheral wall 132 is a circular cylindrical wall standing from the rotation base 131 toward the housing 111. A center axis of the inner peripheral wall 132 coincides with a center axis of the rotation base 131. A housing guide groove 132*a* that guides a housing guide section 133 described later is formed in the inner peripheral surface of the inner peripheral wall 132. The housing guide groove 132*a* is formed in the shape of the sine wave having a constant period to meander on the inner peripheral surface of the inner peripheral wall 132. And, the top edge of the inner peripheral wall 132, which is near the housing 111, is formed into a meandering shape corresponding to the meandering shape of the housing guide groove 132*a*.

The housing guide section 133 has the shape that projects from the bottom surface of the housing 111 which is opposed to the rotation base 131 toward inside the inner peripheral wall 132. And the housing guide section 133 has the shape that the front end thereof bends toward the inner surface of the inner peripheral wall 132. The bottom surface of the housing 111 is a circle shape. The two housing guide sections 133 project from the edge of the bottom surface of the housing 111 and are provided at diametrically opposite positions with respect to the center of the bottom of the housing 111. And the front end of the housing guide section 133 engages the housing guide groove 132*a* through a bearing. The front end of the housing guide section 133 can move in the housing guide groove 132*a* on the basis of this structure.

The outer peripheral wall 134 is a wall of a circular cylindrical shape that encloses the inner peripheral wall 132. The outer peripheral wall 134 is provided to stand on the support rotation base 131 toward the housing 111. A center axis of the outer peripheral wall 134 coincides with the center axis of the support rotation base 131. A housing guide groove 134*a* that guides an exhaust tube guide section 135 described later is provided on the inner peripheral surface of the outer peripheral wall 134. The housing guide groove 134*a* is formed in the shape of the sine wave having the same period as the housing guide groove 132*a* to meander on the inner peripheral surface of the outer peripheral wall 134. The top edge of the outer peripheral wall 134, which is near the housing 111, is formed into a meandering shape corresponding to the meandering shape of the housing guide groove 134*a*.

The exhaust tube guide section 135 has the shape that projects from the bottom surface of the exhaust tube 113 which is opposed to the rotation base 131 toward inside the outer peripheral wall 134. And exhaust tube guide section 135 has the shape that the front end thereof bends toward the inner surface of the outer peripheral wall 134. And the front end of the exhaust tube guide section 135 engages the housing guide groove 134*a* through a bearing. The front end of the exhaust tube guide section 135 can move in the housing guide groove 134*a* on the basis of this structure.

The base rotation motor 136 rotates the rotation base 131 that is supported by the two columns 121*a*. The rotation speed based on this rotation is different from the rotation speed of the housing 111, which is rotated by the exhaust air, when the stopper 141 or the pushing arm 142 does not operate.

Moreover, it is not specified whether the rotation direction of the rotation base 131 is the same rotation direction as the housing 111 or not. However, the base rotation motor 136 rotates the rotation base 131 so that the rotation base 131 rotates relative to the housing 111.

The inner peripheral wall 132 and the outer peripheral wall 134 on the rotation base 131 rotate relative to the housing 111 based on the rotation of the base rotation motor 136. As a result, the front end of the housing guide section 133 moves in the housing guide groove 132*a* of the inner peripheral wall 132, and the front end of the exhaust tube guide section 135 moves in the housing guide groove 134*a* of the outer peripheral wall 134.

The housing 111 repeats to move up and down in the direction denoted by arrow J in FIG. 4 along the support shaft 121*b*_1 while the front end of the housing guide section 133 moves along a meandering path of the housing guide groove 132*a*. In addition, the front end of the exhaust tube 113 repeats to move up and down in the direction denoted by arrow K in FIG. 4 along the rotation shaft 114*a* while the front end of the exhaust tube guide section 135 moves along a meandering path of the housing guide groove 134*a*.

Here, as illustrated in FIG. 3, the exhaust tube guide section 135 is provided at the position that shifts from the extension line of line up of the housing guide sections 133. Therefore, the front end of the exhaust tube 113 moves up and down in a phase different from a phase that the housing 111 moves up and down. As a result, the front end of the exhaust tube 113 moves up and down relative to the housing 111. And, the air is exhausted from the exhaust tube 113 while changing the direction of the exhaust tube 113 upward or downward in each angle direction on the circumference that centers on the support shaft 121*b*_1. The axis of the support shaft 121*b*_1 intersects with the axis of the exhaust tube 113 when the exhaust tube 113 swings in upward direction or in downward direction.

The blow fan unit 100 according to the first embodiment includes the stopper 141, the pushing arm 172, an arm drive motor 150 and a magnetic sensor 160, in addition to the component described above.

The stopper 141 includes a first stopper arm 141*a* and a second stopper arm 141*b*.

A first end of the first stopper arm 141*a* is coupled with the support shaft 121*b*_1. And, the first stopper arm 141*a* extends toward the outside of the peripheral surface side of the housing 111. The support shaft 121*b*_1 is rotatably provided with the support plate 121*b* as described above, and the housing 111 is rotatably provided with the support shaft 121*b*_1. As a result, the first stopper arm 141*a* rotatably rotates about the center axis of the housing 111. Moreover, a second end of the first stopper arm 141*a*, which is located at the opposite side of the first end of the first stopper arm 141*a*, is located at the downstream side of the movement direction of the exhaust tube 113 synchronized with the rotation of the housing 111.

A first end of the second stopper arm 141*b* is coupled with the second end of the first stopper arm 141*a* which is located at the opposite side of the support shaft 121*b*_1. And, a second end of the second stopper arm 141*b* extends to the movement path of the exhaust tube 113 synchronized with the rotation of the housing 111.

The pushing arm 142 includes a first pushing arm 142*a* and a second pushing arm 142*b*.

A first end of the first pushing arm 142*a* is coupled with the support shaft 121*b*_1. And, the first pushing arm 142*a* extends toward the outside of the peripheral surface side of the housing 111. The support shaft 121*b*_1 is rotatably provided with the support plate 121*b*, and the housing 111 is rotatably provided with the support shaft 121*b*_1 as described above. As a result, the first pushing arm 142*a* rotatably rotates about the center axis of the housing 111. Moreover, a second end of the first pushing arm 142*a*, which is located at the opposite side of the first end of the first pushing arm 142*a*, is located at the upstream side of the movement direction of the exhaust tube 113 synchronized with the rotation of the housing 111.

A first end of the second pushing arm 142*b* is coupled with the second end of the first pushing arm 142*a*. A second end of the second pushing arm 142*b* extends to the movement path of the exhaust tube 113.

In the first embodiment, the exhaust tube 113 is provided between the second stopper arm 141*b* and the second pushing arm 142*b*. The exhaust tube 113 is provided at a slight gap with the second stopper arm 141*b* and is provided at a slight gap with the second pushing arm 142*b*.

The arm drive motor 150 is coupled with the support shaft 121*b*_1 through an electromagnetic clutch. And, the stopper 141 and the pushing arm 142 are coupled with the support shaft 121*b*_1 as described above.

The electromagnetic clutch of this arm drive motor 150 is off as an initial state, when a power source of the blow fan system 10 is on. The electromagnetic clutch is turned on/off by the instruction of the control device 300 while the power supply as described later is on. Moreover, the electromagnetic clutch is turned off as the power supply to the electromagnetic clutch is turned off, if the power supply to the blow fan system 10 is turned off while the electromagnetic clutch is on.

In the first embodiment, the arm drive motor 150 is used as a brake that stops the rotation of the support shaft 121*b*_1 when the electromagnetic clutch is on. The arm drive motor 150 stops the rotation of support shaft 121*b*_1. Thereby, the rotation of the first stopper arm 141*a* which is coupled with the support shaft 121*b*_1 is stopped. As a result, the second stopper arm 141*b* makes contact with the exhaust tube 113 at the downstream side of the movement direction of the exhaust tube 113 synchronized with the rotation of the housing 111, and stops the rotation of the housing 111.

In the first embodiment, the stopper 141 which includes the first stopper arm 141*a* and the second stopper arm 141*b* corresponds to one example of a stopper that stops the rotation of the housing 111 by blocking the movement of the exhaust tube 113. Moreover, the arm drive motor 150 corresponds to one example of a switch mechanism that switches between the block and restart of the movement of the exhaust tube 113 by the stopper 141. In the first embodiment, the stopper 141 that extends from the center axis of the housing 111 is described as one example of a stopper. However, a stopper that stops the rotation of housing 111 is not limited to the stopper 141. For example, a stopper that stops the rotation of housing 111 may extend from the bottom surface or inner side surface of the housing 111 to block the movement of the exhaust tube 113.

Moreover, in the first embodiment, when the electromagnetic clutch is on, the arm drive motor 150 also rotates the support shaft 121*b*_1 in the same direction as the rotation direction of the housing 111 that is generated by the reaction force due to the exhaust air. In addition, when the arm drive motor 150 rotates the support shaft 121*b*_1 like this, the arm drive motor 150 rotates the support shaft 121*b*_1 at a higher rotation speed than that of the housing 111 which is generated by the reaction force due to the exhaust air. Since the arm drive motor 150 rotates the support shaft 121*b*_1 in the direction described above and at the speed described above, the first pushing arm 142*a* is moved at a higher rotation speed than that of the housing 111. As a result, since the second pushing arm 142*b* pushes the exhaust tube 113 from the upstream side of the movement direction synchronized with the rotation of the housing 111, the housing 111 is moved at a faster rotation speed than that of the housing 111 which is caused by the reaction force due to the exhaust air.

When the electromagnetic clutch of the arm drive motor 150 is off, the support shaft 121*b*_1 rotates following the rotation of the housing 111 as the stopper arm 141*b* is pushed by the exhaust tube 113 that is moved by the rotation of the housing 111.

In the first embodiment, the on-off of the electromagnetic clutch of the arm drive motor 150, namely, the rotation of the arm drive motor 150 is controlled by the control device 300.

The control device 300 controls the rotation of the arm drive motor 150 to stop the rotation of the housing 111 and controls the direction of the airflow by pushing the exhaust tube 113 using the second pushing arm 142*b*. The control device 300 corresponds to one example of a control device that controls the direction of the airflow in the blower fan system.

One magnetic sensor 160 is provided with the inner surface of the column 121*a* at left side illustrated in FIG. 4 in the two columns 121*a*. The detection result data of the magnetic sensor 160 is transmitted to the control device 300. Here, a permanent magnet 113*b* is coupled with the bottom surface of the exhaust tube 113, which is as illustrated in FIG. 4. In the first embodiment, the control device 300 determines that the exhaust tube 113 turns to the left column 121*a* when the magnetic sensor 160 detects the magnetic field from the permanent magnet 113*b*. In the first embodiment, the angle direction of the arm drive motor 150 is determined as a home position, namely as 0 degrees when the exhaust tube 113 turns to the left column 121*a*.

In the blow fan system 10 including the blow fan unit 100 described above, each of the temperature sensors 200 is provided at each location where the temperature rise is likely to occur in the room where the blow fan system 10 is arranged. For instance, as the specific installation location of each temperature sensor 200 is located near each computer in the room where a plurality of computers is arranged. Each temperature sensor 200 detects a temperature at a constant time interval. And, the temperature data of the detection result is transmitted to the control device 300. Moreover, the identification number for identifying the temperature sensor 200 is allocated to each temperature sensor 200. The each temperature sensor 200 transmits the temperature data with the identification number of each temperature sensor 200 to the control device 300.

The control device 300 controls the rotation of the fan rotation motor 114, the rotation of the arm drive motor 150, and the on/off of the electromagnetic clutch of the arm drive motor 150.

Figure 5:
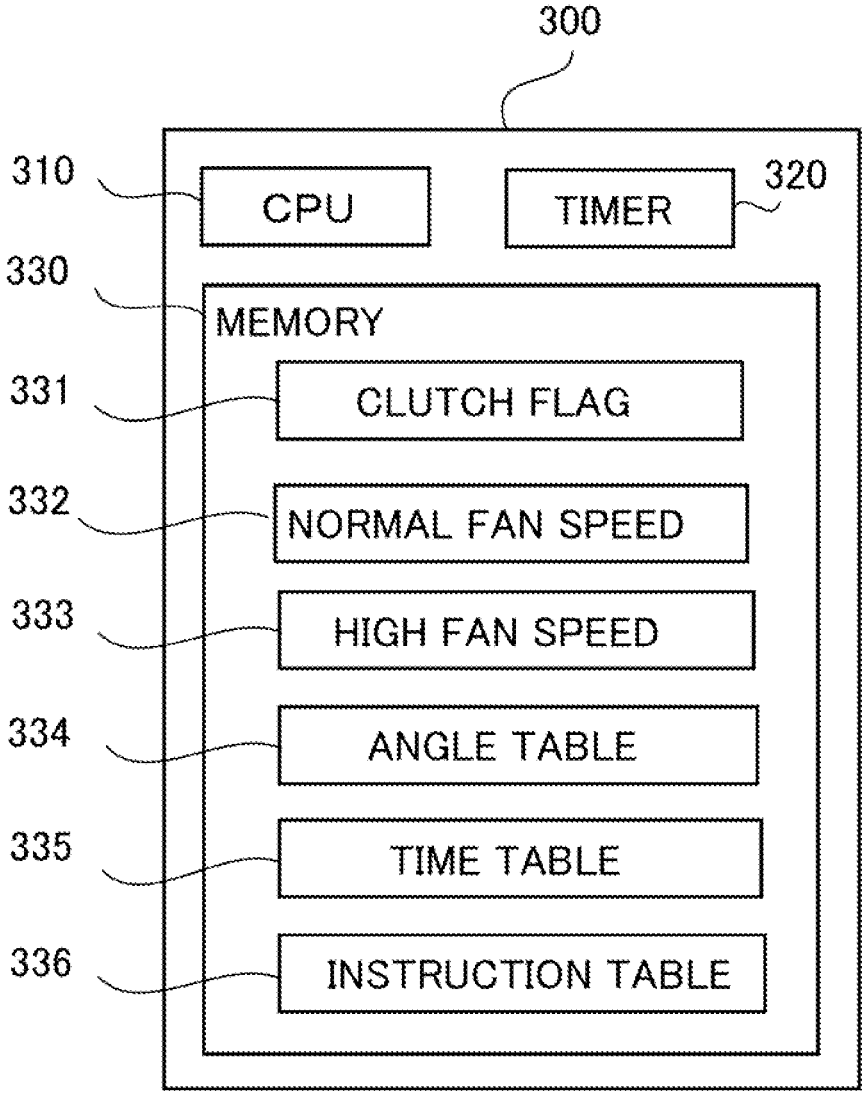
FIG. 5 schematically illustrates an inner structure of a control device.

FIG. 5 schematically illustrates an internal structure of the control device 300.

The control device 300 includes a CPU (Central Processing Unit) 310, a timer 320, and a memory 330 as illustrated in the FIG. 5.

The CPU 310 executes the control processing described later.

The timer 320 measures an elapsed time after the rotation of the housing 111 is stopped by the stopper 141.

The memory 330 stores a clutch flag 331, a normal fan speed 332, a high fan speed 333, an angle table 334, a time table 335, and an instruction table 336.

The clutch flag 331 is a flag that indicates whether the electromagnetic clutch of the arm drive motor 150 is on or off. When the CPU 310 turns on the electromagnetic clutch, the CPU 310 stores "1" in the memory 330 as the clutch flag 331. When the CPU 310 turns off the electromagnetic clutch, the CPU 310 stores "0" in the memory 330 as the clutch flag 331. Moreover, when the power supply to the blower fan system 10 is turned off, the electromagnetic clutch is forcibly turned off as described above. Therefore, in the first embodiment, when the power supply is turned off, "0" is stored in the memory 330 as the clutch flag 331. Therefore, "0" is stored in the memory 330 as an initial value of the clutch flag 331 when the power supply to the blower fan system 10 is turned on.

The normal fan speed 332 has a normal rotational speed of the fan rotation motor 114, namely, a normal rotational speed of the fan 112. The high fan speed 333 has a high rotational speed that is higher than the normal fan speed.

FIGS. 6A to 6C illustrate the angle table 334, the time table 335 and the instruction table 336 illustrated in FIG. 5 in detail.

FIG. 6A illustrates in detail the angle table 334 illustrated in FIG. 5. FIG. 6B illustrates in detail the time table 335 illustrated in FIG. 5. FIG. 6C illustrates in detail the instruction table 336 illustrated in FIG. 5.

The angle table 334 indicates that the identification numbers 1, 2, . . . , n for identifying the respective temperature sensors 200 correspond to the angle directions theta 1, theta 2, . . . theta n. Each of the angle directions is the angle direction of the arm drive motor 150 when the exhaust tube 113 is turned to each installation location of the temperature sensors 200 by the pushing arm 142. The angle direction of the home position (standard position) of the arm drive motor 150 is the angle direction when the exhaust tube 113 is turned to the left column 121*a* by the pushing arm 142 in FIG. 4. The angle table 334 is stored in the memory 330 by a designer at the time of design or by an installation provider at the time of installation when each installation location of the temperature sensors 200 in the room is determined.

The time table 335 indicates that respective temperature ranges corresponds to the blower fan unit stop times t1, t2, . . . , tn (t1<t2< . . . <tn). A temperature is indicated by d in the time table 335. The plurality of the temperature ranges are a first temperature range, a second temperature range, . . . , and nth temperature range. The first-temperature range is below the first threshold temperature D1. The second temperature range is equal to or above D1 and is below the second threshold temperature D2. The nth temperature range is equal to or above the nth threshold temperature Dn. In the first embodiment, the time table 335 indicates that a higher temperature range corresponds to a longer blower fan unit stop time. The time table 335 is also stored in the memory 330 by a designer at the time of design or by an installation provider at the time of installation.

The instruction table 336 is different from the above-described two tables. The CPU 310 stores data in the instruction table 336 in the control processing described later.

Though the detail is described later, the CPU 310 selects the angle directions theta a, theta b, . . . among the plurality of the angle directions theta 1, theta 2, . . . , theta n in the angle table 334 to instruct the arm drive motor 150 in the control processing. In addition, the CPU 310 selects the blower fan unit stop times ta, tb, . . . among the plurality of the blower fan unit stop times t1, t2, . . . , tn in the time table 335 to stop the rotation of the arm drive motor 150. And, The CPU 310 stores the selected angle directions theta a, theta b, . . . in the angle table 334 corresponding to the selected blow fan unit stop times ta, tb, . . . in the time table 335 into the instruction table 336, respectively.

Hereinafter, the control processing executed by CPU 310 is described.

Figure 7:
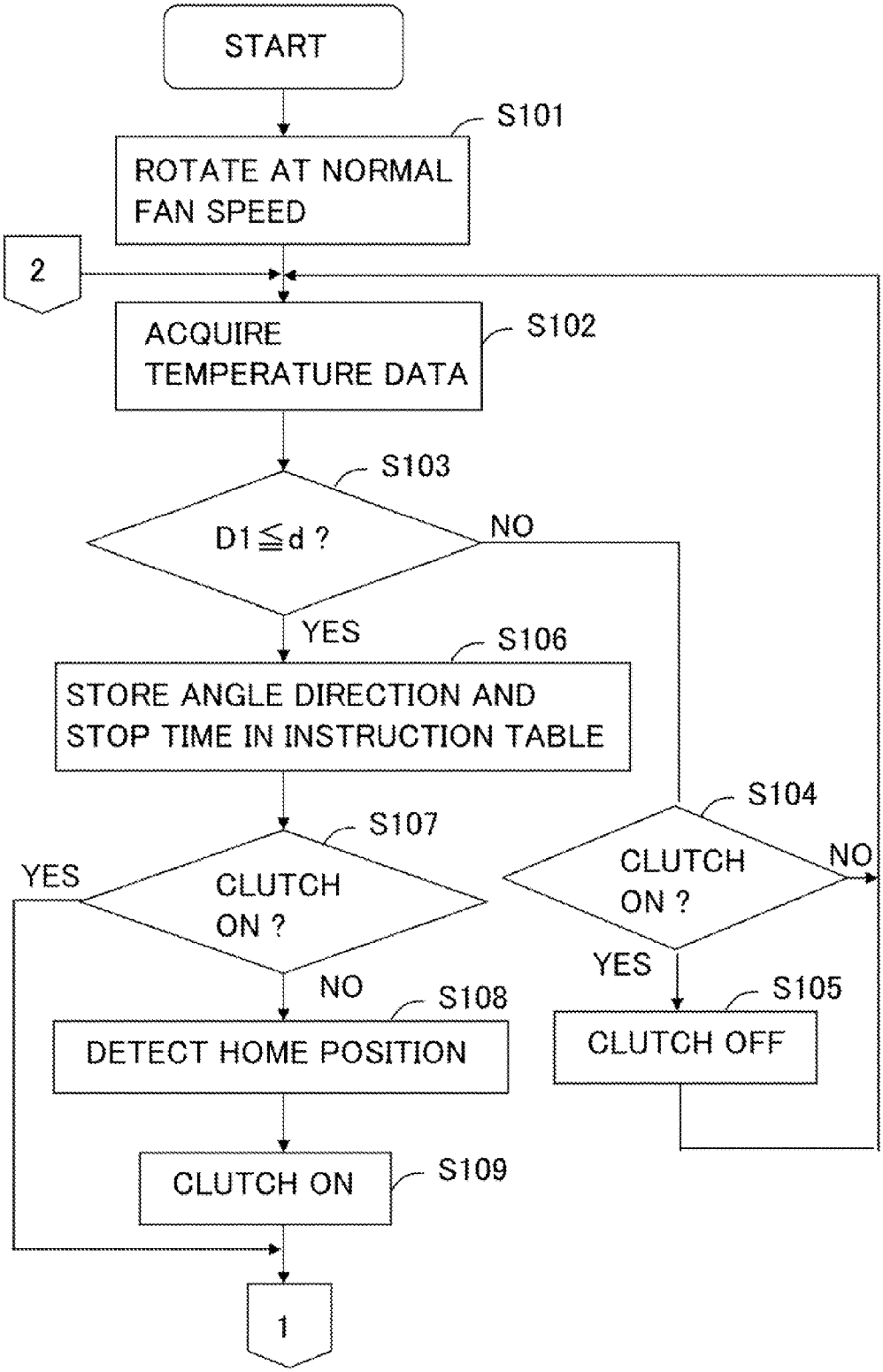
FIG. 7 illustrates the first half of a flow chart of a control processing that is executed by CPU illustrated in FIG. 5.
Figure 8:
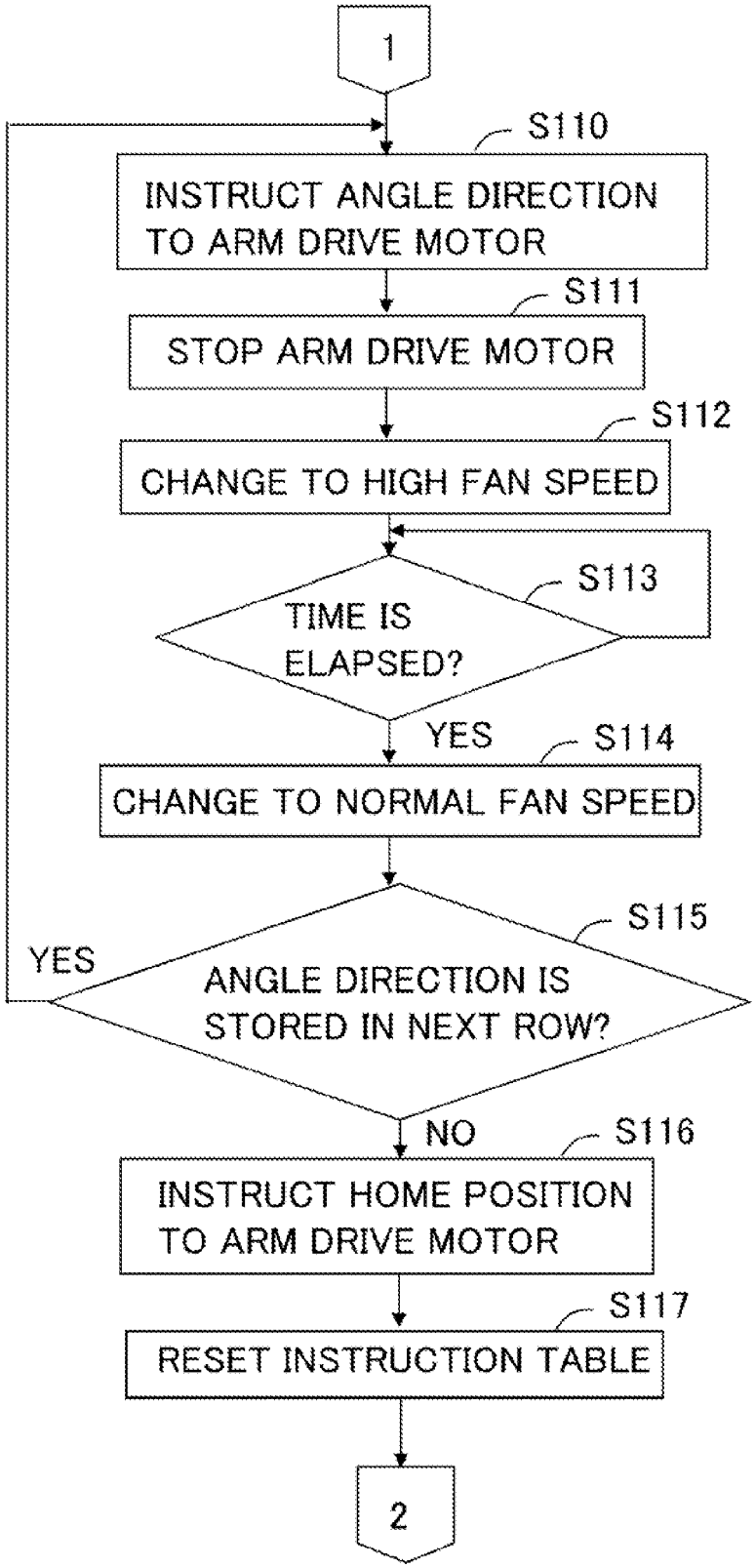
FIG. 8 illustrates the second half of a flow chart of a control processing that is executed by CPU illustrated in FIG. 5.

FIG. 7 illustrates the first half of a flow chart of the control processing that is executed by CPU 310 illustrated in FIG. 5. FIG. 8 illustrates the second half of the flow chart of the control processing that is executed by CPU 310 illustrated in FIG. 5.

When the temperature equals to or above the first threshold temperature D1 is detected, the flow chart illustrates the control processing that the CPU 310 controls to move the exhaust tube 113 toward the temperature sensor 200 which detects the temperature and to stops the rotation of the housing 111 until a predetermined time corresponding to the detected temperature is elapsed. This control processing is repeatedly executed by the CPU 310 while the power supply to the blower fan system 10 illustrated in FIG. 3 and FIG. 4 is on.

The flow chart illustrates the control processing that starts when the power supply to the blower fan system 10 is turned on. In the blower fan system 10, the transmission of the temperature data from the plurality of the temperature sensors 200 to the control device 300 starts when the power supply is turned on.

When the control processing starts, first of all, the CPU 310 first reads the normal fan speed from the memory 330, and drives the fan rotation motor 114 at the normal fan speed 332 (step S101). Then, the fan 112 starts the rotation at the normal fan speed 332 and generates the airflow. Subsequently, the exhaust air starts flowing out of the exhaust tube 113. And, the housing 111 starts the rotation by the reaction force due to the exhaust air.

Next, the CPU 310 acquires the temperature data from each temperature sensor 200 (step S102).

Then, the CPU 310 determines whether the acquired temperature data indicates a high temperature equals to or above the first threshold temperature D1 (step S103).

The CPU 310 executes the next step S104, when the CPU 310 determines that there is no temperature data "d" indicating a temperature equals to or above the first threshold temperature D1 (No in step S103).

In step S104, the CPU 310 checks whether the clutch flag 331 stored in the memory 330 is "1", and determines whether the electromagnetic clutch of the arm drive motor 150 is on.

Here, as illustrated in the flow charts of FIG. 7 and FIG. 8, the control processing is repeatedly executed while the power supply to the blower fan system 10 is on. In the first control processing immediately after the power supply is turned on, the electromagnetic clutch is off. Therefore, in step 104, the CPU 310 determines that the electromagnetic clutch is off (No in step 104), and the processing returns to step S102. On the other hand, in the second and subsequent control processing, the electromagnetic clutch may be turned on in a previous control processing by a processing in step 109 described later. In this case, in the step 104, the CPU 310 determines that the electromagnetic clutch is on (Yes in step 104). And, the CPU 310 turns off the electromagnetic clutch (step S105) and the processing returns to step 102.

On the other hand, when the CPU 310 determines that there is a temperature data "d" indicating a temperature equals to or above the first threshold temperature D1 in step S103 (Yes in step S103), the CPU 310 executes the next step S106.

In step S106, the CPU 310 acquires the angle direction corresponding to the identification number attached to the temperature data which indicates a temperature equals to or above the first threshold temperature D1, from the angle table 334. Moreover, CPU 310 acquires the blower fan unit stop time corresponding to the temperature range, to which the temperature data "d" described above belongs, from the time table 335. In addition, the CPU 310 associates the acquired angle direction with the acquired blower fan unit stop time and stores them into the instruction table 336. When the number of the temperature data that indicates a temperature equals to or above the first threshold temperature D1 is one, one set of the angle direction and the blower fan unit stop time is stored in the instruction table 336. Moreover, when the number of the temperature data that indicates a temperature equals to or above the first threshold temperature D1 are two or more, a plurality of sets of the angle directions and the blower fan unit stop times are stored in the instruction table 336. Moreover, when the plurality of sets of the angle directions and the blower fan unit stop times are stored in the instruction table 336, the CPU 310 stores each set of the angle direction and the blower fan unit stop time from the first row of the instruction table 336 in ascending order of the angle direction.

Next, the CPU 310 checks whether or not the clutch flag stored in the clutch flag 331 in FIG. 5 is "1", and determines whether the electromagnetic clutch of the arm drive motor 150 is on (step S107).

The CPU 310 is in a stand-by state until the exhaust tube 113 turns to the left column 121*a* and the magnetic field is detected with the magnetic sensor 160, when the electromagnetic clutch is off (No in step S107). And, when the magnetic field is detected with magnetic sensor 160, the CPU 310 determines that the angle direction of the arm drive motor 150 is the angle direction of the home position (step S108). When the home position is detected like this, the CPU 310 turns on the electromagnetic clutch (step S109). Moreover, in this step S109, the CPU 310 overwrites "1" as the clutch flag 331 into memory 330.

In the first embodiment, the arm drive motor 150 is a stepping motor that an arbitrary angle direction of the rotation of the arm drive motor 150 can be specified. And, the stepping motor internally has a home position that becomes a standard in the angle direction. However, whether or not the electromagnetic clutch is on when the arm drive motor 150 is oriented in which angle direction is not certain in the first embodiment. Therefore, the correspondence between the direction of the original home position of the arm drive motor 150 and the direction of the stopper arm 141 or the direction of the pushing arm 142 becomes uncertain. Therefore, in the first embodiment, when the home position described above is detected besides the original home position, the CPU 310 turns on the electromagnetic clutch. And, the detected home position is used as a new standard of the angle direction of the arm drive motor 150 when the electromagnetic clutch turned on.

Moreover, in the second and subsequent control processing, in some cases, the electromagnetic clutch is already on in the previous control processing as described above. In this case, the CPU 310 determines whether the electromagnetic clutch is on (Yes in step S107), and the detection processing of the home position (step S108) and "on" processing of the electromagnetic clutch (step S109) are omitted.

Next, the CPU 310 instructs the arm drive motor 150 an angle direction as follows (step S110). In this step S110, the CPU 310 instructs the arm drive motor 150 an angle direction stored at uppermost row among the angle directions, which are not instructed to the arm drive motor 150, in the instruction table 336. When the angle direction is instructed like this, the arm drive motor 150 starts rotating. Then, the housing 111 is moved by the pushing arm 142 as illustrated in FIG. 3 at the faster rotation speed than the rotation speed base on the reaction force due to the exhaust air. As a result, exhaust tube 113 moves toward the temperature sensor 200 that detects a high temperature equals to or above the first threshold temperature D1.

And, when the arm drive motor 150 arrived at the instructed angle direction, the CPU 310 stops the rotation of arm drive motor 150 (step S111).

Here, though not illustrated in FIGS. 3 to 5, the blower fan system 10 in the first embodiment includes a power supply unit that supplies power to the fan rotation motor 114, the arm drive motor 150, and the base rotation motor 136. The CPU 310 controls start/stop of the rotation of various motors and on/off of the electromagnetic clutch of the arm drive motor 150 by transmitting various instruction signals to the power supply unit.

The CPU 310 reads high fan speed 333 from the memory 330 illustrated in FIG. 5, and changes the fan speed of the fan rotation motor 114 from the normal fan speed to the high fan speed (step S112). Thereby, the rotation of the fan 112 at the normal fan speed ends, and the rotation of the fan at the high fan speed starts.

In addition, the CPU 310 monitors a time elapsed since the stop instruction of the rotation by the timer 320 (step S113). When the elapsed time reaches to the blower fan unit stop time corresponding to the angle direction in the instruction table 336 (Yes in step S113), the CPU 310 proceeds to a processing of next step S114.

In step S114, the CPU 310 reads the normal fan speed 332 in FIG. 5 from the memory 330, and changes the fan speed of the fan rotation motor 114 from the high fan speed to the normal fan speed (step S114). Then, the rotation speed of the fan 112 returns from the high fan speed to the normal fan speed.

By the above processing, from the exhaust tube 113 toward the temperature sensor 200 which detects a high temperature, the air generated by the rotation of the fan 112 at the high fan speed is exhausted during the blower fan unit stop time.

Next, the CPU 310 determines whether the angle direction which is not instructed is stored in the next row of the angle direction which is instructed in the instruction table 336 (step S115).

When the angle direction that is not instructed is stored in the next row (Yes in step S115), the processing returns to step S110 and the processing from step S110 to step S114 is repeated.

On the other hand, when the angle direction which is instructed is the angle direction in the lowermost row in the instruction table 336 (No in step S115), the CPU 310 instructs the arm drive motor 150 to move to the home position, namely 0 degrees as an angle direction (step S116). And, when the arm drive motor 150 reaches the home position, the CPU 310 resets the instruction table 336 to delete all of the stored data (step S117). The processing returns to step S102 after the processing in this step S117 is completed.

When there is the temperature sensor 200 that detects a high temperature, the housing 111 makes one rotation while the air is intensively exhausted toward the temperature sensor 200 by the control processing described above. When the housing 111 makes one rotation and returns to the home position, a next rotation of the housing 111 by the next control processing starts. In the first embodiment, the above-mentioned control processing is executed repeatedly while the power supply of the blower fan system 10 is on.

According to the blower fan system 10 in the first embodiment described above, the air for cooling is intensively exhausted from blow fan unit 100 to the high temperature location where the temperature especially rises in the room to be cooled, at which the blower fan system 10 is disposed. As a result, the room is evenly cooled even if the rise of the temperature is uneven at many locations in the room to be cooled.

Moreover, the stopper 141 includes the first stopper arm 141*a* and the second stopper arm 141*b*. The first stopper arm 141*a* rotates rotatably around the rotation center axis of the housing 111. The second stopper arm 141*b* is coupled with the second front end of the first stopper arm 141*a* and projects from the movement path of the exhaust tube 113. The arm drive motor 150 is used as a brake that stops the rotation of the first stopper arm 141*a*. Moreover, when the electromagnetic clutch of the arm drive motor 150 is off, the brake is released. In the first embodiment, on the basis of a simple configuration that includes the stopper arm 141 having the two arms and the electromagnetic clutch being turned on and off, the CPU 310 easily controls start and stop of the rotation of the exhaust tube 113 and housing 111.

This means that a following application is preferable for a blower fan unit and a blower fan system.

In this application, the stopper includes the first arm and the second arm. The first arm extends from the rotation center axis of the housing toward outside the peripheral surface of the housing and rotates rotatably around the rotation center axis of the housing. The second arm is coupled with the first arm and projects on the movement path of the exhaust tube. And, the switch mechanism is a releasable brake that stops the rotation of the first arm.

The stopper 141 in the first embodiment corresponds to one example of a stopper that includes the first arm and the second arm. Moreover, the first stopper arm 141*a* in the first embodiment corresponds to one example of a first arm. Moreover, the second stopper arm 141*b* in the first embodiment corresponds to one example of a second arm. Moreover, the arm drive motor 150 that has the electromagnetic clutch in the first embodiment corresponds to one example of a switch mechanism that has a releasable brake. However, the switch mechanism is not limited to the arm drive motor 150. For instance, the switch mechanism may be a lock mechanism that releasably engages the first arm.

Moreover, in the first embodiment, the pushing arm 142 is driven to rotate by the arm drive motor 150. Therefore the exhaust tube 113 and the housing 111 are pushed in the rotation direction by the reaction force due to the exhaust air. The exhaust tube 113 is turned to a direction that intensively exhausts the air at faster speed than the rotation speed generated by the reaction force due to the exhaust air, on the basis of this structure in the present embodiment. As a result, as the air is exhausted to the high temperature portion in the room quickly, the room is cooled early.

This means that it is preferable that a blower fan unit or a blower fan system includes a drive mechanism which pushes the exhaust tube in the rotation direction of the housing.

The drive mechanism that includes the pushing arm 142, the support shaft 121*b*_1, and the arm drive motor 150 in the first embodiment corresponds to one example of a drive mechanism. In addition, here, as one example of a drive mechanism, the drive mechanism that includes the pushing arm 142, which extends from the rotation center axis of the housing 111, is described above. However, this drive mechanism is not limited to the mechanism that includes the pushing arm 142. For instance, the drive mechanism may be a mechanism having an arm which extends from the inner surface or bottom surface of the housing and pushes the exhaust tube.

Moreover, in the first embodiment, the fan 112 rotates at higher speed than the normal fan speed when the housing 111 rotates, while the rotation of housing 111 is stopped. As a result, the exhaust tube 113 is turned to a direction that intensively exhausts the air and a large amount of air for cooling is exhausted by the high speed rotation of the fan 112 while the rotation of housing 111 is stopped. As a result, the room can be cooled more quickly.

This means that it is preferable as an application for a blower fan unit and a blower fan system that the fan rotates at higher speed than the movement speed of the exhaust tube, while the stopper blocks the movement of the exhaust tube.

The fan 112 in the first embodiment also corresponds to one example of a fan that rotates at higher speed than the movement speed of the exhaust tube while the stopper blocks the movement of the exhaust tube.

Moreover, in the first embodiment, the front end of the exhaust tube 113 swings vertically by the displacement mechanism 130 as denoted by arrow K in FIG. 4, while the housing 111 rotates. In the first embodiment, as an exhaust direction is displaced in the vertical direction by the swing of the exhaust tube 113, the air evenly is exhausted to each location in the vertical direction in the room. As a result, the room is efficiently cooled.

This means that a following application is preferable for a blower fan unit and a blower fan system.

In this application, the exhaust tube is provided with the peripheral surface of the housing and swings swingably about the swinging shaft. The swinging axis of the exhaust tube intersects with the axis of the rotation shaft of the housing. In this application, the exhaust tube displacement mechanism is coupled with the exhaust tube and allows the exhaust tube to swing swingably about the swinging shaft.

The exhaust tube 113 in the first embodiment corresponds to one example of an exhaust tube that is swingably provided with the peripheral surface of the housing. Moreover, the displacement mechanism 130 in the first embodiment corresponds to one example of a displacement mechanism of the exhaust tube that swings the exhaust tube.

Moreover, in the first embodiment, the displacement mechanism 130 includes the rotation base 131, the base rotation motor 136, the exhaust tube guide section 135 extending from the exhaust tube 113 and the outer peripheral wall 134. The outer peripheral wall 134 has the housing guide groove 134*a* which guides the front end of the exhaust tube guide section 135. As a result, the exhaust tube 113 swings along the housing guide groove 134*a* by a simple operation that the base rotation motor 136 rotates the rotating base 131.

This means that a following application is more preferable with respect to an application including the exhaust tube displacement mechanism.

In this application, the exhaust tube displacement mechanism includes a base, a base rotation mechanism, an exhaust tube guide section and an exhaust tube guide peripheral wall. The base has a surface that intersects with the axis of the rotation shaft of the housing and spreads. The base is supported rotatably about the axis of the rotation shaft of the housing by the support unit. The base rotation mechanism rotates the base relative to the housing. The exhaust tube guide section extends toward the base from the exhaust tube, and turns in the direction that the front end thereof is away from the axis of the rotation shaft of the housing along the surface of the base. The exhaust tube guide peripheral wall is a peripheral wall to enclose the axis of the rotation shaft of the housing from the base toward the housing and to stand in the cylinder shape from the base. An exhaust tube guide groove is provided on the inner peripheral surface of the exhaust tube guide peripheral wall. The exhaust tube guide groove is annularly formed on the inner peripheral surface of the exhaust tube guide peripheral wall with changing the distance from the base. The exhaust tube guide groove guides the exhaust tube guide section synchronized with the rotation of the base as the front end of the exhaust tube guide section engages the exhaust tube guide groove movably.

The displacement mechanism 130 in the first embodiment corresponds to one example of an exhaust tube displacement mechanism. Moreover, the rotation base 131 in the first embodiment corresponds to one example of a base that the exhaust tube displacement mechanism includes. Moreover, the base rotation motor 136 in the first embodiment corresponds to one example of a base rotation mechanism that the exhaust tube displacement mechanism includes. Moreover, the exhaust tube guide section 135 in the first embodiment corresponds to one example of an exhaust tube guide section which extends from the exhaust tube. Moreover, the outer peripheral wall 134 in the first embodiment corresponds to one example of an exhaust tube guide peripheral wall on which an exhaust tube guide groove is provided.

Moreover, in the first embodiment, the housing 111 is displaced in the vertical direction as denoted by arrow J in FIG. 4 while rotating by displacement mechanism 130. Thereby, the exhaust tube 113 is also displaced in the vertical direction by the vertical movement of this housing 111. As a result, for instance, it becomes possible to enlarge the swing of the exhaust tube 113 in combination with the displacement in the vertical direction of the exhaust tube 113. The air in the room can is exhausted more widely in vertical direction by such operation.

This means that a following application is preferable for a blower fan unit and a blower fan system. In this application, the blower fan unit and the blower fan system include a housing displacement mechanism. The housing displacement mechanism is coupled with the housing and changes the position of the housing in the direction that intersects with the rotation direction of the housing.

The displacement mechanism 130 in the first embodiment corresponds to one example of a housing displacement mechanism that changes the position of the housing.

Moreover, in the first embodiment, the displacement mechanism 130 includes the rotation base 131, the base rotation motor 136, the housing guide section 133 extending from the housing 111, the inner peripheral wall 132 having the housing guide groove 132*a* that guides the front end of the housing guide section 133. As a result, the position of the housing is displaced along the housing guide groove 132*a* by a simple operation that rotates the rotating base 131 by the base rotation motor 136.

This means that a following application is more preferable to an application that includes a housing displacement mechanism.

In this application, the housing displacement mechanism includes a base, a base rotation mechanism, a housing guide section, and a housing guide peripheral wall. The base has a surface that intersects with the axis of the rotation shaft of the housing and spreads, and the base is supported rotatably about the axis of the rotation shaft of the housing by the support unit. The base rotation mechanism rotates the base relative to the housing. The housing guide section extends toward the base from the housing, and turns in the direction that the front end thereof is away from the axis of the rotation shaft of the housing along the surface of the base. The housing peripheral wall is a peripheral wall to enclose the axis of the rotation shaft from the base toward the housing and to stand in the cylinder shape from the base. A housing guide groove is provided on the inner peripheral surface of the housing guide peripheral wall. The housing guide groove is annularly formed on the inner peripheral surface of the housing guide peripheral wall with changing the distance from the base. The housing guide groove guides the housing guide section synchronized with the rotation of the base as the front end of the housing guide section engages the housing guide groove movably.

The displacement mechanism 130 in the first embodiment corresponds to one example of a housing displacement mechanism. Moreover, the housing guide section 133 in the first embodiment corresponds to one example of a housing guide section extending from the housing. Moreover, the inner peripheral wall 132 in the first embodiment corresponds to one example of a housing guide peripheral wall having a housing guide groove.

Moreover, in the first embodiment, the control device 300 controls start and stop of the rotation of housing 111 by the stopper 141 on the basis of temperatures detected by a plurality of temperature sensors 200 which are provided at many locations in the room for cooling. As a result, the air is exhausted to the high temperature location where the temperature rises especially in the room to be cooled.

This means that a following application is preferable to a blower fan system.

In this application, the blower fan system includes a blower fan unit and a plurality of temperature sensors that detect a temperature at each different location along in the rotation direction of the housing. The plurality of temperature sensors are provided in the area where the air from the blower fan unit reaches. And, in this application, the control device acquires the temperature detected by the temperature sensors, and operates the switch mechanism on the basis of the acquired detection temperature.

The plurality of temperature sensors 200 in the first embodiment corresponds to one example of a plurality of temperature sensors that detects the temperature in each location in the area. Moreover, the control device 300 in the first embodiment corresponds to one example of a control device that operates the switch mechanism on the basis of the detected temperature.

Moreover, the control device 300 stores the angle direction for turning the exhaust tube 113 and the first threshold temperature D1 for determining whether to stop the rotation of the housing 111 in the memory 330. And, the control device 300 instructs the arm drive motor 150 to turn in the angle direction corresponding to the temperature sensor 200 that detects the temperature that is higher than or equal to the first threshold temperature D1. Thereby, the air is exhausted to the location where the temperature rises especially in the room.

This means that a following application is preferable to a blower fan system.

In this application, the blower fan system includes a plurality of temperature sensors that detect the temperature at each location in the room. The control device controls the airflow to blow to each location. Moreover, the control device stores each of blocking positions of the stopper corresponding to each of the temperature sensors and predetermined threshold temperatures in the memory. The each of the blocking positions is a position that exhausts the airflow at each location in the room. The control device acquires the temperature detected by each temperature sensor, and allows the stopper to block the movement of the exhaust tube at the blocking position corresponding to the temperature sensor that detects the temperature which exceeds the threshold temperature.

The control device 300 in the first embodiment corresponds to one example of a control device that allows the stopper to block the movement of the exhaust tube at the blocking position corresponding to the temperature sensor that detects the temperature which exceeds the threshold temperature.

Moreover, in the first embodiment, when the temperature detected by the temperature sensor belongs to higher temperature range in the time table 335, the rotation of the housing 111 is stopped longer. Thereby, when the air is intensively exhausted to the location where the temperature has become high, the higher the temperature at the location rises, the longer the air effectively is exhausted toward the location.

This means that a following application is preferable to a blower fan system.

In this application, the blower fan system includes a plurality of temperature sensors that detect the temperature at each location in the room. Moreover, in this application, the control device controls the air so as to be exhausted to each location. And, the control device stores each of blocking positions of the stopper corresponding to each of the temperature sensors in the memory. And, the control device acquires the temperature detected by each temperature sensor, and allows the stopper to block the movement of the exhaust tube at the blocking position corresponding to the temperature sensor. The higher the temperature at the blocking position rises, the longer the stopper blocks the movement of the exhaust tube.

The control device 300 in the first embodiment is one example of a control device that allows the stopper to block the movement of the exhaust tube longer when the detected temperature rises higher.

Next, a second embodiment is described.

In the second embodiment, a stopper, a pushing arm, an arm drive motor, and a control device are different from the first embodiment. In the following, the second embodiment is described by focusing on these differences.

Figure 9:
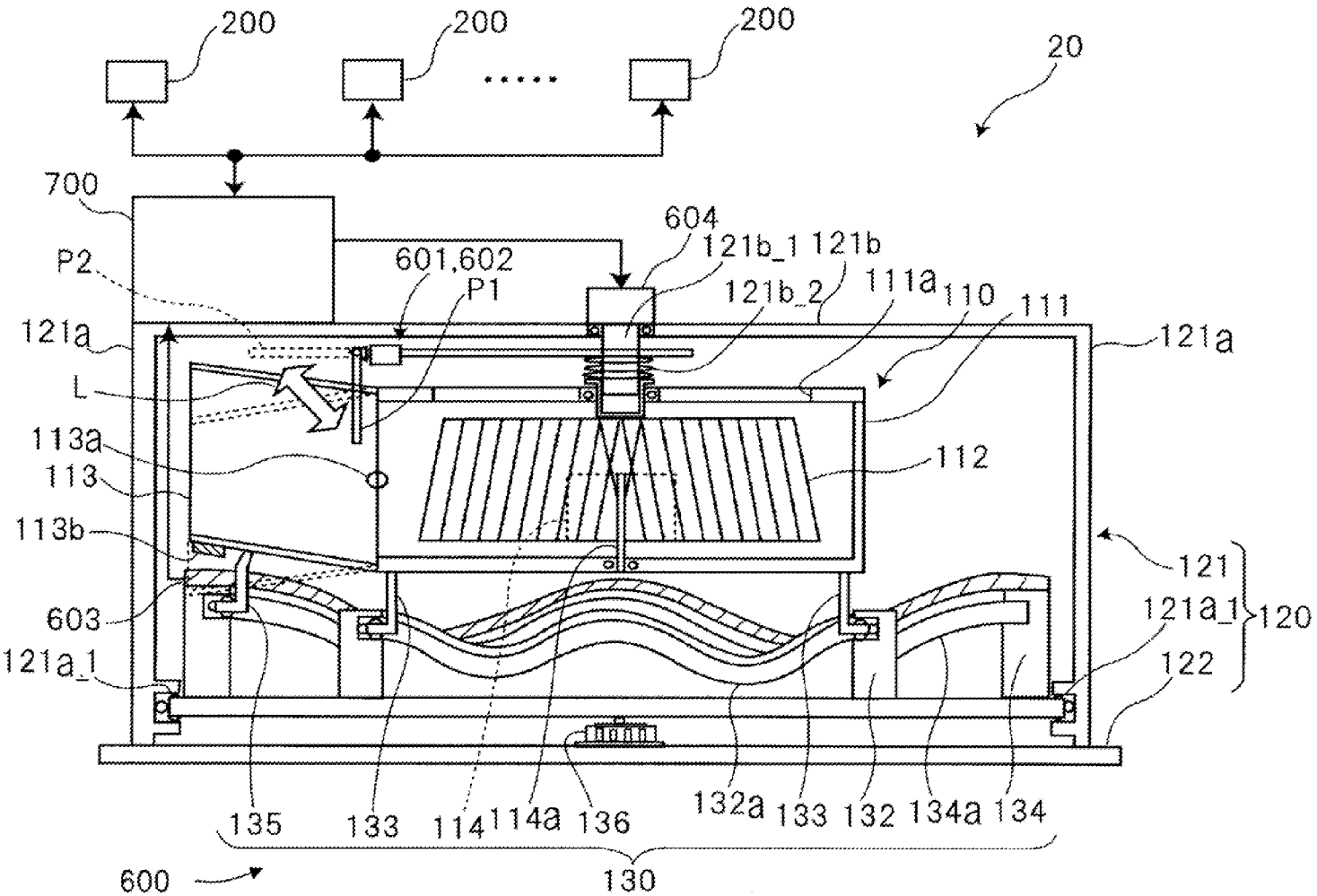
FIG. 9 schematically illustrates according to a second embodiment focusing on an inner structure of a blow fan unit of a blow fan system.

FIG. 9 schematically illustrates a blow fan system according to the second embodiment focusing on an inner structure of the blow fan unit.

The components illustrated in FIG. 9 are given the same reference numerals as those of the corresponding components of the blower fan system 10 of the first embodiment illustrated in FIG. 4. The description of the common components is omitted to avoid redundancy below.

A blower fan system 20 in the second embodiment includes a movable stopper 601 and a movable pushing arm 602 that a part of an arm is movable. These two arms mutually have the same movable structure as each other. In the following, as for the movable structure of the movable stopper 601 and the movable structure of the movable pushing arm 602, the movable structure of the movable stopper 601 is described as an example of the representative.

Figure 10A:
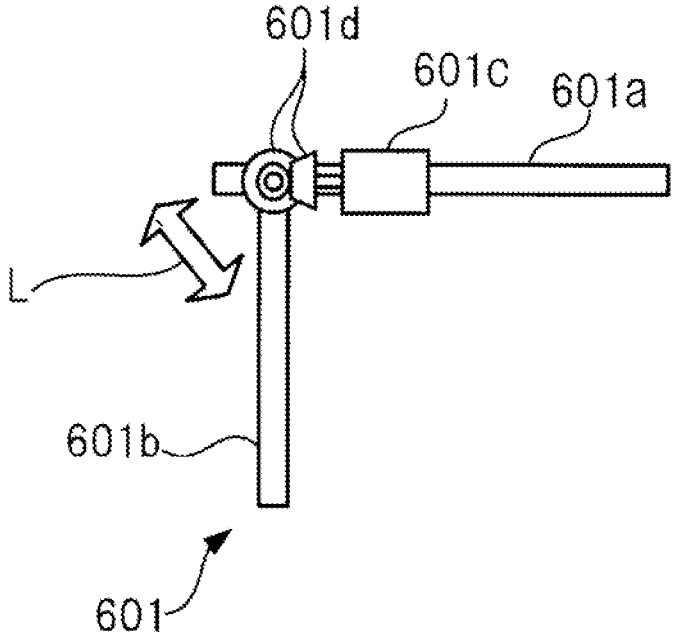
FIGS. 10A and 10B illustrate in detail a movable structure of a movable stopper.
Figure 10B:
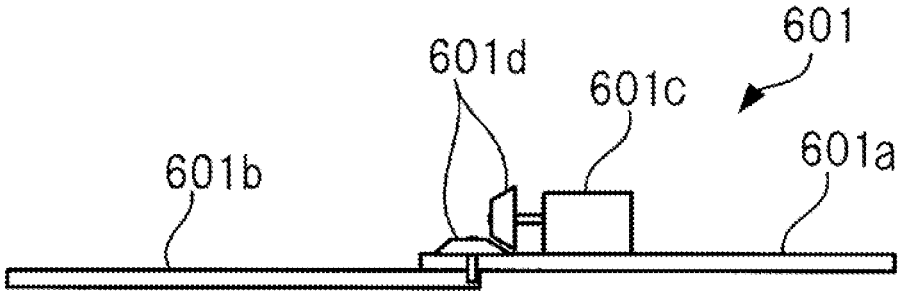

FIGS. 10A and 10B illustrate in detail a movable structure of the movable stopper 601.

FIG. 10A illustrates a side view of the movable stopper 601. Moreover, FIG. 10B illustrates a top view of the movable stopper 601.

The movable stopper 601 has a first fixed arm 601*a* which has a first end coupled with the support shaft 121*b*_1 in FIG. 9, and a first rotation arm 601*b* that is rotatably coupled with a second end of the fixed arm 601*a* in the direction denoted by arrow L in FIGS. 9 and 10.

Moreover, the movable stopper 601 includes a rotation motor 601*c* that rotates the first rotation arm 601*b*. The rotation motor 601*c* is mounted on the second end of the first fixed arm 601*a*. And, the rotation shaft of the rotation motor 601*c* and the first rotation arm 601*b* are coupled with two gears 601*d* that engages mutually.

When the rotation motor 601*c* rotates, the movement of rotation shaft of the rotation motor 601*c* is transmitted to the first rotation arm 601*b* through the two gears 601*d*, and thereby the first rotation arm 601*b* rotates in the direction denoted by arrow L. In the second embodiment, the rotation amount of the first rotation arm 601*b* is about 90 degrees. Namely, the first rotation arm 601*b* may take two positions that are a first position P1 illustrated by the solid line in FIG. 9 and a second position P2 that rotates about 90 degrees from the first position P1.

As illustrated in FIG. 9, the first position P1 is a block position at which the first rotation arm 601*b* projects on the movement path of the exhaust tube 113 and blocks the movement of the exhaust tube 113. Moreover, the second position P2 is a retraction position that is away from the movement path of the exhaust tube 113, and the second position P2 extends in the same direction as the first fixed arm 601*a*. A control device 700 drives the rotation motor 601*c* as described later, and thereby a switch between the first position P1 and second position P2 of the rotation arm 601*b* is performed.

The movable pushing arm 602 in the second embodiment has a movable structure similar to the movable stopper 601. The movable pushing arm 602 includes a second fixed arm and a second rotation arm. And, the first end of the first fixed arm 601*a* and the first end of the second fixed arm are fixed to the support shaft 121*b*_1 so that the distance between the second end of the first fixed arm 601*a* which holds the first rotation arm 601*b* and the second end of the second fixed arm which holds the second rotation arm is slightly wider than the width of exhaust tube 113.

The first rotation arm 601*b* and the second rotation arm (hereinafter called rotation arms) are positioned at the second positions P2 as an initial state, when a power supply to the blower fan system 20 is turned on. The positions of the rotation arms as described later are properly changed while turning on the power supply. Moreover, when the rotation arms are positioned at the first positions P1 and the power supply to the blower fan system 20 is turned off, the power supply stops after the positions of the rotation arms are switched to the second positions P2.

In the second embodiment, when a temperature detected by the temperature sensor 200 is under the first threshold temperature D1, the position of the movable stopper 601 and the position of the movable pushing arm 602 are at the second positions P2, namely at the retraction positions. As a result, the housing 111 keeps rotating by the reaction force due to the exhaust air as the rotation of the housing 111 is not blocked by the movable stopper 601 and the movable pushing arm 602.

And, when one temperature detected by the temperature sensor 200 becomes the first threshold temperature D1 or above, the support shaft 121*b*_1 is driven to rotate so that the moving exhaust tube 113 is placed between the movable stopper 601 and the movable pushing arm 602. And, at that position, the rotation arms are switched to the first positions P1. The exhaust tube 113 is placed between the rotation arms. Then, as the support shaft 121*b*_1 is further driven to rotate while the exhaust tube 113 is placed between the rotation arms, the housing 111 is pushed to move. Thereby, the exhaust tube 113 is turned in a direction which the air is exhausted.

Thus, in the second embodiment, the blower fan system 20 has a structure that the moving exhaust tube 113 is caught by the rotation arms. In the second embodiment, a position sensor 603, which detects the position of the moving exhaust tube 113, is mounted on the top of the outer peripheral wall 134 extending over 360 degrees as illustrated in FIG. 9. The position sensor 603 detects the position of the exhaust tube 113 by detecting the position of the magnetic field where the permanent magnet 113*b*, which is mounted on the bottom of the exhaust tube 113, radiates. The result obtained by the position sensor 603 is transmitted to the control device 700.

Moreover, the rotation shaft of the arm drive motor 604 in the second embodiment is fixedly coupled with the support shaft 121*b*_1, while the rotation shaft of the arm drive motor 150 in the first embodiment is coupled with the support shaft 121*b*_1 through the electromagnetic clutch. Moreover, the arm drive motor 604 in the second embodiment is a stepping motor as well as the arm drive motor 150 in the first embodiment. And the arm drive motor 604 has a home position. In the second embodiment, as the rotation shaft of the arm drive motor 604 is fixedly coupled with the support shaft 121*b*_1, the home position of the arm drive motor 604 is used as a home position in the blower fan unit 600.

Next, the control device 700 in the second embodiment is described.

The control device 700 controls to catch the exhaust tube 113 using the rotation arms and to rotate the arm drive motor 604.

Figure 11:
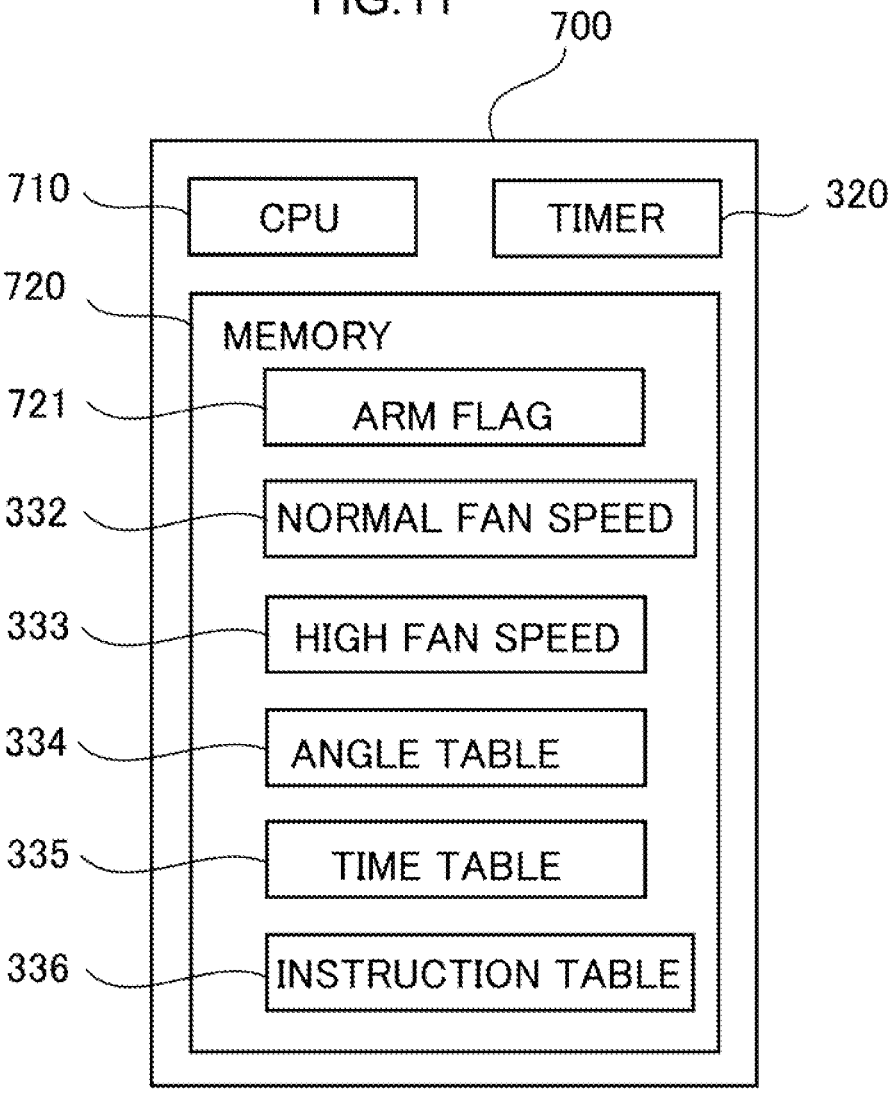
FIG. 11 schematically illustrates an inner structure of a control device.

FIG. 11 schematically illustrates an inner structure of the control device 700.

The components illustrated in FIG. 11 are given the same reference numerals as those of the corresponding components of the control device 300 of the first embodiment illustrated in FIG. 5. The description of the common components is omitted to avoid redundancy.

The control device 700 in the second embodiment, as components different from the first embodiment, includes a CPU 710 which executes a control processing described later and a memory which stores an arm flag 721.

The arm flag 721 is a flag that indicates whether each position of the rotation arms is at the position P1, namely, whether the exhaust tube 113 is caught by the rotation arms. When the positions of the rotation arms are switched to the positions P1 by the CPU 710, "1" is stored into the memory 720 as the arm flag 721. And, when the positions of the rotation arms are switched to the position P2, "0" is stored into the memory 720 as the arm flag 721. Moreover, the positions of the rotation arms are forcibly switched to the position P2 in the second embodiment as described above when the power supply to the blower fan system 20 is turned off. Therefore, in the second embodiment, "0" is also stored into the memory 720 as the arm flag 721 when the power supply is turned off.

Next, the control processing executed by the CPU 710 is described.

In the second embodiment, the latter half of the flow chart that illustrates the control processing of the CPU 710 is the same as the latter half of the flow chart that illustrates the control processing of the first embodiment illustrated in FIG. 8. Therefore, only the first half of the flow chart that illustrates the control processing of the CPU 710 is described in the following, and the description of the common latter half of the flow chart is omitted to avoid redundancy.

Figure 12A:
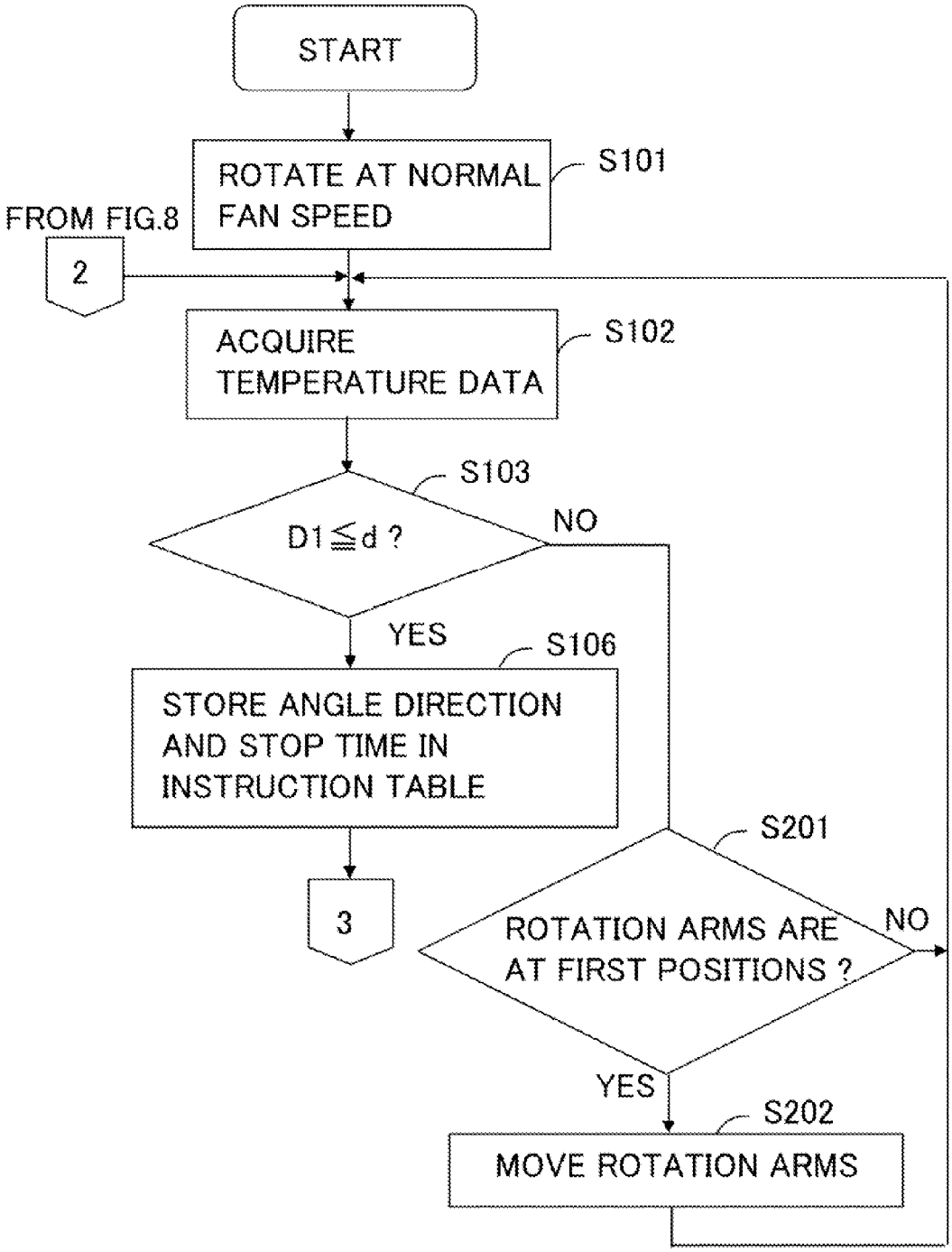
FIGS. 12A and 12B illustrate the first half of a flow chart of a control processing that is executed by CPU illustrated in FIG. 11.
Figure 12B:
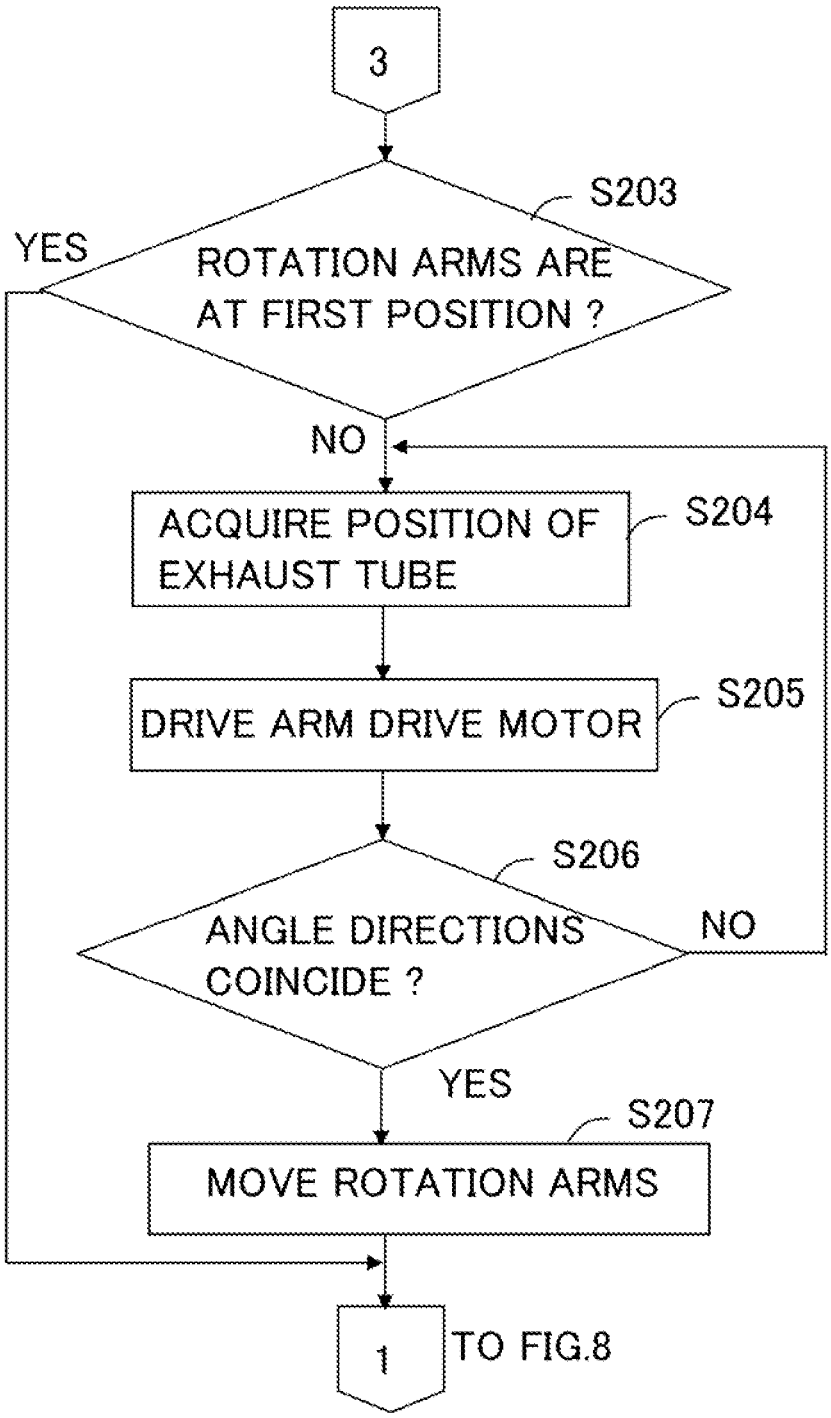

FIGS. 12A and 12B illustrate the first half of the flow chart of the control processing that is executed by the CPU 710 illustrated in FIG. 11.

The first half of the flow chart of the control processing of the first embodiment illustrated in FIG. 7 includes the same steps as the first half of the flow chart illustrated in FIGS. 12A and 12B. The steps illustrated in FIGS. 12A and 12B are given the same step numbers as those of the corresponding steps illustrated in FIG. 7. The description of the common steps is omitted to avoid redundancy.

In step S101, when the power supply to the blower fan system 20 is turned on and the control processing starts, the CPU 710 drives the fan rotation motor 114 at the normal fan speed.

In step S102, the CPU 710 acquires the temperature data. In step S103, the CPU 710 determines whether or not there is at least one high temperature data which indicates a temperature that is equal to or above the first threshold temperature D1 among the acquired temperature data.

The CPU 710 executes the next step S201 when there is no high temperature data (No in step S103).

In step S201, the CPU 710 determines whether or not the positions of the rotation arms are at the first position P1. Therefore, the CPU 710 determines whether or not the arm flag 721 stored into the memory 720 in FIG. 11 is "1".

Here, this control processing is executed repeatedly while the power supply to the blower fan system 20 is on. In the first control processing immediately after turning on the power supply, the positions of the rotation arms are at the second positions P2. Therefore, in step S201, when it is determined that the positions of the rotation arms are at the second position P2, the control processing returns to step S102 (No in step S201). On the other hand, in a second or later control processing, the positions of the rotation arms may be at the first positions P1 by the control processing in step 207 described later in a previous control processing. In this case, in step 201, it is determined that the positions of the rotation arms are at the first positions P1 (Yes in step S201).

In step 202, the CPU 710 moves the rotation arms of the movable stopper 601 and movable pushing arm 602 from first positions P1 to the second positions P2. And the processing returns to step 102.

On the other hand, in step 102, when the CPU 710 determines that there is at least one high temperature data among the acquired temperature data (Yes in step 103), in step 106, the CPU 710 acquires the angle direction and the blower fan unit stop time, and stores them into the memory 720.

In step 203, the CPU 710 determines whether or not the positions of the rotation arms are at the first positions P1. Therefore the CPU 710 determines whether or not the arm flag 721 stored into the memory 720 in FIG. 11 is "1".

When the positions of the rotation arms are not at the first positions P1 but at the second positions P2 (No in step S203), the CPU 710 executes the next step S204.

In step S204, the CPU 710 acquires the current position of the exhaust tube 113 by the detection result transmitted from the position sensor 603. Next, the CPU 710 converts the acquired position into an angle direction based on the home position of the arm drive motor 604.

In step 205, the CPU 710 drives the arm drive motor 604 in the converted angle direction, and allows the movable stopper 601 and the movable pushing arm 602 to move to the acquired position in step 204.

In step 206, the CPU 710 acquires the position of the exhaust tube 113 and converts the acquired position into an angle direction after moving to the acquired position. And, the CPU 710 determines whether or not the angle direction of the arm drive motor 604 coincides with the converted angle direction of the exhaust tube 113.

The processing returns to step S204 when the angle direction of the arm drive motor 604 does not coincide with the converted angle direction (No in step S206), and repeats from step 204 to step 206. These step S204 and step S205 are repeated until the angle direction of the arm drive motor 604 coincides with the converted angle direction in step S206 (Yes in step S206).

In step 207, the CPU 710 drives the rotation motor 601*c* of the movable stopper 601 and the rotation motor of the movable pushing arm 602 until the rotation arms moves at the first positions P1, when the angle direction of the arm drive motor 604 coincides with the converted angle direction in step S206. As a result, the exhaust tube 113 comes to be caught by the rotation arms.

After the exhaust tube 113 is caught, the same processing as the processing in the first embodiment illustrated in FIG. 8 is performed, and the air intensively is exhausted toward each location in the room to be cooled where the high temperature is detected with the temperature sensor 200. And, the control processing described above is repeatedly executed while turning on the power supply to the blower fan system 20.

Also, in the second embodiment described above, as the air intensively is exhausted toward the location in the room where the high temperature is detected as well as the first embodiment, the room is evenly cooled even if the rise of the temperature is uneven at many locations in the room.

Moreover, in the second embodiment, the movable stopper 601 includes the first fixed arm 601*a* and the rotation arm 601*b*. The first fixed arm 601*a* is fixed with the support shaft 121*b*_1 that is rotationally driven by the arm drive motor 604. The rotation arm 601*b* is rotatably coupled with the second end of the first fixed arm 601*a* rotatably and rotates between the first position P1 and the second position P2. The rotation motor 601*c* mounted on the first fixed arm 601*a* switches the position of the rotation arm 601*b*. And, the movement of the exhaust tube 113 may be free when all of the temperature sensors 200 detect low temperatures. Therefore the rotation arm 601*b* is positioned at the second position P2 that is away from the movement path of the exhaust tube 113. Therefore, the rotation shaft of the arm drive motor 604 and the support shaft 121*b*_1 with which the first fixed arm 601*a* is fixed are firmly coupled. As a result, the structure of the arm drive motor 604 is simple. In addition, a home position that the arm drive motor 604 originally has can be used as a home position in this blower fan system 20. Therefore the processing is easy.

This means that a following application is preferable for a blower fan unit and a blower fan system.

In this application, the stopper includes a first arm and a second arm. The first arm extends from the rotation center axis of the housing toward a peripheral surface of the housing and can rotate about the rotation center axis of the housing. The second arm is coupled with the first arm and projects on the movement path of the exhaust tube. And, in this application, the switch mechanism drives the second arm and switches the position of the second arm between the blocking position on the movement path of the exhaust tube and the retraction position that is away from the movement path of the exhaust tube.

The movable stopper 601 in the second embodiment corresponds to one example of a stopper that includes a first arm and a second arm and that the position of the second arm is switched between the blocking position and the retraction position. Moreover, the first fixed arm 601*a* in the second embodiment corresponds to one example of a first arm in the application. Moreover, the rotation arm 601*b* in the second embodiment corresponds to one example of a second arm in the application. And, the rotation motor 601*c* in the second embodiment corresponds to one example of a switch mechanism that switches the position of the second arm between the blocking position and the retraction position. Moreover, as one example of a drive mechanism of the second arm (the rotation arm 601*b*), the rotation drive mechanism is described above. However the drive mechanism may not limit to the rotation drive mechanism. For example, a slide drive mechanism may be used as the drive mechanism.

As the embodiments of the blower fan unit, the exhaust tube is placed between the stopper that blocks the movement path and the pushing arm that pushes the exhaust tube or the housing. However, the blower fan unit is not limited to the disclosed embodiments, the blower fan unit may have only the stopper.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A blower fan unit comprising:

a housing having an outlet opened on a peripheral surface of the housing and an inlet opened on a surface other than the peripheral surface of the housing;

a fan to generate airflow from the inlet to the outlet, the fan being arranged in the housing;

a support unit including a support shaft to support the housing so that the housing is rotatable around the support shaft;

an exhaust tube projecting from the outlet, the exhaust tube producing a reaction force by guiding the airflow toward an upstream side of movement of the peripheral surface synchronized with rotation of the housing, the reaction force rotating the housing toward a downstream side of the movement of the peripheral surface of the housing;

a stopper being positioned on a movement path of the exhaust tube that moves with the rotation of the housing to stop the rotation of the housing by blocking movement of the exhaust tube; and a switch mechanism to switch blocking and restarting of the movement of the exhaust tube using the stopper, wherein the stopper includes a first arm that extends from the support shaft toward the peripheral surface of the housing and is rotatable around a center axis of the housing, and a second arm that is coupled with the first arm and projects on the movement path of the exhaust tube, wherein the switch mechanism is a releasable brake that stops the rotation of the first arm.

2. The blower fan unit according to claim 1, wherein the switch mechanism controls the second arm to switch a position between a retraction position that is away from the movement path of the exhaust tube and a blocking position.

3. The blower fan unit according to claim 1, further comprising a drive mechanism to push the exhaust tube in a rotation direction of the housing.

4. The blower fan unit according to claim 1, wherein the fan rotates while the stopper blocks the movement of the exhaust tube at a speed of rotation faster than a speed of rotation of the fan when the exhaust tube is rotating.

5. The blower fan unit according to claim 1, the blower fan unit further comprising an exhaust tube displacement mechanism that is coupled with the exhaust tube and allows a front end of the exhaust tube to move up and down, wherein the exhaust tube is provided with the peripheral surface of the housing.

6. The blower fan unit according to claim 5, wherein the exhaust tube displacement mechanism includes a base that has a surface that intersects with the center axis of the housing, and is supported so the base is rotatable about the center axis of the housing by the support unit, a base rotation mechanism that rotates the base independently of the housing, an exhaust tube guide section that extends toward the base from the exhaust tube, in which its front end is bent in a direction away from the center axis of the housing along the surface of the base, and an exhaust tube guide peripheral wall that is mounted on the base and is formed into a cylindrical shape so that a center axis of the exhaust tube guide peripheral wall coincides with a center axis of the base, the exhaust tube guide peripheral wall has an exhaust tube guide groove that is provided on its inner peripheral surface, wherein the exhaust tube guide groove is annularly formed on the inner peripheral surface with varying distances from the base and guides the exhaust tube guide section synchronized with the rotation of the base as the front end of the exhaust tube guide section movably engages with the exhaust tube guide groove.

7. The blower fan unit according to claim 1, the blower fan unit further comprising a housing displacement mechanism that is coupled with the housing and allows the housing to move up and down.

8. The blower fan unit according to claim 7, wherein the housing displacement mechanism includes a base that has a surface that intersects with the center axis of the housing, and is supported so the base is rotatable about the center axis of the housing by the support unit, a base rotation mechanism that rotates the base independently of the housing, a housing guide section that extends toward the base from the housing and turns, in which its front end is bent in a direction away from the center axis of the housing along the surface of the base, and a housing guide peripheral wall that is mounted on the base and is formed into a cylindrical shape so that a center axis of the housing guide peripheral wall coincides with a center axis of the base, the housing guide peripheral wall has an housing guide groove that is provided on its inner peripheral surface, wherein the housing guide groove is annularly formed on the inner peripheral surface with varying distances from the base and guides the housing guide section synchronized with the rotation of the base as the front end of the housing guide section movably engages with the housing guide groove.

9. A blower fan system comprising:

a blower fan unit including a housing having an outlet opened on a peripheral surface of the housing and an inlet opened on a surface other than the peripheral surface of the housing, a fan to generate airflow from the inlet to the outlet, the fan being arranged in the housing, a support unit to support the housing so the housing is rotatable;

an exhaust tube projecting from the outlet, the exhaust tube producing a reaction force by guiding the airflow toward an upstream side of movement of the peripheral surface synchronized with the rotation of the housing, the reaction force rotating the housing toward a downstream side of the movement of the peripheral surface of the housing, a stopper being positioned on a movement path of the exhaust tube that moves with the rotation of the housing to stop the rotation of the housing by blocking movement of the exhaust tube, and a switch mechanism to switch blocking and restarting of the movement of the exhaust tube using the stopper; a temperature sensor to detect temperature and is arranged at a location in the area where the airflow from the blower fan unit reaches; and a control device to acquire temperatures detected by the temperature sensor and to control the switch mechanism on the basis of the acquired detection temperature.

10. The blower fan system according to claim 9, the system further comprising a memory to store a blocking position of the stopper corresponding to the temperature sensor and a predetermined threshold temperature, wherein the control device acquires from the memory the blocking position corresponding to the temperature sensor that detects the temperature which exceeds a threshold temperature and controls the switch mechanism to block the movement of the exhaust tube using the stopper at the blocking position acquired.

11. The blower fan system according to claim 10, wherein the control device controls the switch mechanism so that the higher the temperature at the blocking position rises, the longer the stopper blocks the movement of the exhaust tube.

12. The blower fan system according to claim 10, the system further comprising a drive mechanism to push the exhaust tube in a rotation direction of the housing, wherein the exhaust tube is pushed by the drive mechanism toward the blocking position at a speed of rotation faster than a speed of rotation of the exhaust tube when the exhaust tube is only driven by the reaction force.

13. The blower fan system according to claim 10, wherein the fan rotates at a speed faster than a movement speed of the exhaust tube while the stopper blocks the movement of the exhaust tube.

14. The blower fan system according to claim 10, wherein, the support unit includes a support shaft to support the housing so the housing is rotatable around the support shaft, the stopper includes a first arm that extends from the support shaft toward the peripheral surface of the housing and that is rotatable around a center axis of the housing, and a second arm that is coupled with the first arm and that can project on the movement path of the exhaust tube, wherein the switch mechanism is a releasable brake that stops rotation of the first arm.

15. The blower fan system according to claim 14, wherein, the blower fan unit further includes a position sensor being mounted on the support unit and to detect a position of the exhaust tube, wherein the switch mechanism includes an arm drive motor to move the stopper in rotation direction of the housing, wherein when the control device detects the position of the exhaust tube using the position sensor as a home position, the control device controls the switch mechanism to brake the first arm of the stopper and controls the arm drive motor to move the stopper to the blocking position from the home position.

16. The blower fan system according to claim 10, wherein the support unit includes a support shaft to support the housing so that the housing is rotatable around the support shaft, the system further comprising a pushing arm to push the exhaust tube, the pushing arm including a first pushing arm that extends from the support shaft toward the peripheral surface of the housing and is rotatable around a center axis of the housing, and a second pushing arm that is coupled with the first pushing arm and can project on the movement path of the exhaust tube, and the pushing arm is rotatable about the center axis of the housing, wherein, the stopper includes a first arm that extends from the support shaft toward the peripheral surface of the housing and is rotatable around the center axis of the housing, and a second arm that is coupled with the first arm and can project on the movement path of the exhaust tube, wherein, the switch mechanism switches between retraction positions that are away from the movement path of the exhaust tube and positions that the exhaust tube is placed between the second arm and the second pushing arm.

17. The blower fan system according to claim 16, wherein the blower fan unit further includes a peripheral wall surrounding the housing, position sensors being mounted on the top of the peripheral wall, and an arm drive motor to move the stopper and pushing arm in rotation direction of the housing, wherein when the second arm of the stopper and the second pushing arm are at the retraction positions and the control device detects the position of the exhaust tube using the position sensors which detects the position of the exhaust tube, the control device controls the arm drive motor to move the stopper and the pushing arm to the position detected of the exhaust tube and controls the switch mechanism to place the exhaust tube between the second arm and the second pushing arm, and the control device controls the arm drive motor so that the pushing arm and the stopper move toward the blocking position at a speed of rotation faster than a speed of rotation of the exhaust tube when the exhaust tube is only driven by the reaction force.

* * * * *